US006540502B2

(12) United States Patent
Butler

(10) Patent No.: US 6,540,502 B2
(45) Date of Patent: Apr. 1, 2003

(54) MECHANICAL DRIVE ASSEMBLY FOR A BRICK MOLDING APPARATUS

(75) Inventor: Philip G. Butler, Salisbury, NC (US)

(73) Assignee: Anvil Iron Works, Inc., Salisbury, NC (US)

( * ) Notice: Subject to any disclaimer, the term of this patent is extended or adjusted under 35 U.S.C. 154(b) by 66 days.

(21) Appl. No.: 09/783,513

(22) Filed: Feb. 14, 2001

(65) Prior Publication Data

US 2001/0025911 A1 Oct. 4, 2001

Related U.S. Application Data

(63) Continuation of application No. 09/669,142, filed on Sep. 26, 2000, now Pat. No. 6,468,065.
(60) Provisional application No. 60/156,541, filed on Sep. 29, 1999.

(51) Int. Cl.[7] ..... B28B 5/02
(52) U.S. Cl. ..... 425/453; 425/261; 198/832.1
(58) Field of Search ..... 425/253, 261, 425/357, 453; 198/832.1

(56) References Cited

U.S. PATENT DOCUMENTS

| | | | | |
|---|---|---|---|---|
| 1,433,417 | A | | 10/1922 | Rosa |
| 4,065,238 | A | | 12/1977 | Sinnema |
| 4,187,268 | A | | 2/1980 | Sinnema |
| 4,378,202 | A | | 3/1983 | Kosman |
| 4,417,979 | A | | 11/1983 | Hofs |
| 4,436,501 | A | | 3/1984 | Kenworthy |
| 4,449,909 | A | | 5/1984 | Kenworthy |
| 4,610,616 | A | | 9/1986 | Kosman |
| 4,832,587 | A | | 5/1989 | Rensen |
| 4,917,838 | A | | 4/1990 | Rensen |
| 5,074,277 | A | | 12/1991 | Milholen |
| 5,131,831 | A | | 7/1992 | Peeters |
| 5,141,429 | A | | 8/1992 | Menninga |
| 5,173,311 | A | | 12/1992 | Rensen |
| 5,612,064 | A | | 3/1997 | Kosman |
| 6,164,437 | A | * | 12/2000 | Brown et al. ..... 198/832.1 |

FOREIGN PATENT DOCUMENTS

| | | |
|---|---|---|
| DE | 260 410 C | 5/1913 |
| EP | 0 917 938 A | 5/1999 |
| NL | 1 011 060 C | 7/2000 |

* cited by examiner

*Primary Examiner*—Jan H. Silbaugh
*Assistant Examiner*—Donald Heckenberg
(74) *Attorney, Agent, or Firm*—Adams, Schwartz & Evans, P.A.

(57) ABSTRACT

In a brick molding apparatus, the improvement includes a mechanical drive assembly for indexing in predetermined incremental movements a mold adapted to receive and shape clay slugs into green bricks. The drive assembly includes a conveyor for carrying the mold in the brick molding apparatus. A drive gear is mounted on a drive shaft and defines a plurality of circumferentially-spaced teeth and radially-extending slots. The drive shaft is operatively connected to the conveyor. A drive lug is adapted for movement into and out of a selected one of the plurality of slots formed in the drive gear. A gear actuator is adapted for moving the drive lug in a rotational direction relative to the drive shaft. When the drive lug is positioned in the selected slot of the drive gear, the gear actuator causes rotation of the drive gear and drive shaft thereby indexing the conveyor and mold.

9 Claims, 30 Drawing Sheets

MECHANICAL DRIVE ASSEMBLY FOR A BRICK MOLDING APPARATUS

BACKGROUND OF THE INVENTION

This invention relates generally to a brick molding apparatus, and more specifically to a mechanical drive assembly adapted for moving a section of the apparatus in predefined increments in a continuous loop for receiving, molding, and discharging green brick. The present apparatus is especially applicable for manufacturing brick which closely resembles a traditional "hand thrown" product. As compared to conventional machine-made brick, brick made by hand is generally more attractive, and can be produced in a wider variety of colors and texture. A significant disadvantage of this product, however, is the labor intensive and time consuming manufacturing process.

The key value of a successfully molded hand-thrown brick lies in the aesthetic visual appearance of the finished product. The physical size of the brick is controlled by the dimension of the mold cavity. More difficult to achieve are the elements of color, finish texture, and other irregularities in shape or surface texture that are obtained during the hand molding process. Bricks thus produced are distinctive in appearance and popular with commercial and residential builders as well as architects and home design professionals. At first glance, it would seem that the only problem to resolve would be to increase volume enough to satisfy demand. This problem could be solved, then, by hiring more molders or designing a machine to produce bricks at a higher rate than is possible using manpower. If volume were the only consideration, the machines developed to meet the demand for hand made (or hand thrown) bricks would have satisfied that demand. With more attention given to an evaluation of the product usage, units sold per lot size, style, color, texture, the like, it has been noticed that hand thrown brick sales do not follow the same patterns as standard bricks, and that the requirements for a machine to simulate hand thrown bricks are considerably different than originally envisioned.

To successfully re-create this product mechanically, any machine designed to produce simulated hand-thrown bricks must be able to mold a high quality product, consistently, and at the same time be flexible enough to manufacture short run special orders for custom design shapes, colors and textures. This need creates a formidable challenge for the hand-thrown brick market—the ability to meet the high-end "designer-type" products without losing time to modify the machine tools and/or materials. While several machines currently available in the industry are able to produce bricks which appear to be hand thrown, the machines are maintenance nightmares and are unable to quickly change either brick size (replace molds) or brick color/texture (change in tooling) to meet the requirement for custom demands.

BRIEF SUMMARY OF THE INVENTION

Therefore, it is an object of the invention to provide a brick molding apparatus which creates brick that closely resembles a hand-thrown product.

It is another object of the invention to provide a brick molding apparatus which enables the production of custom-designed bricks in a cost efficient manner.

It is another object of the invention to provide a brick molding apparatus which is capable of simultaneously manufacturing a variety of colored bricks during a single production run without requiring color changeovers.

It is another object of the invention to provide a brick molding apparatus which is capable of doing a short color run without losing valuable production time.

It is another object of the invention to provide a brick molding apparatus which can be readily and conveniently modified to adjust the brick size.

It is another object of the invention to provide a brick molding apparatus which requires relatively little floor space.

It is another object of the invention to provide a brick molding apparatus which is provides unique markings on the brick for identification.

It is another object of the invention to provide a brick molding process and apparatus which utilizes computer software developed for enabling a fully integrated operating system.

These and other objects of the present invention are achieved in the preferred embodiments disclosed below by providing a mold section of a brick molding apparatus adapted for receiving a plurality of individual clay slugs and molding the clay slugs into green bricks. The mold section includes first and second opposing spaced-apart end plates extending from one end of the mold section to the other. A plurality of spaced-apart side plates are perpendicularly disposed between the opposing end plates. A plurality of adjustable base plates are positioned between the end plates and the side plates. The end plates, side plates, and base plates cooperate to form respective end, side, and bottom walls of a plurality of individual mold cavities. Each of the mold cavities has a length defined by a distance between the opposing end plates, a width defined by a distance between adjacent ones of the side plates, and a depth defined by a distance between the base plate and an open top of the mold cavity. An adjustable base plate support assembly engages the plurality of base plates to locate the base plates a predetermined distance from the open tops of the mold cavities, thereby adjustably setting of the depths of the mold cavities.

According to another preferred embodiment of the invention, the base plate support assembly includes a plurality of base beams located beneath respective base plates and adapted for positioning the base plates within the mold cavities.

According to another preferred embodiment of the invention, the base plate support assembly further includes a cross beam extending from one end of the mold section to the other. The cross beam carries each of the base beams to effect simultaneous position adjustment of the base plates within the mold cavities.

According to another preferred embodiment of the invention, the base plate support assembly further includes first and second cross beam mounting plates attached to respective opposite ends of the cross beam for supporting the cross beam beneath the mold cavities.

According to another preferred embodiment of the invention, opposing mold section mounting plates are located at opposite ends of the mold section for supporting the mold section on respective guide rails of the brick molding apparatus.

According to another preferred embodiment of the invention, the base plate support assembly further includes first and second vertical guide shafts having respective top-and bottom ends. The bottom ends of the guide shafts pass vertically through openings in respective cross beam mounting plates, and the top ends of the guide shafts are secured to respective mold section mounting plates.

According to another preferred embodiment of the invention, the top ends of respective guide shafts are threaded and adapted for receiving complementary-threaded lock nuts. Threaded vertical movement of the guide shafts provides position adjustment of the cross beam and base plates relative to the mold cavities, thereby adjusting the depth of the mold cavities.

According to another preferred embodiment of the invention, the base plate support assembly further includes respective springs formed around the guide shafts between the cross beam mounting plates and the mold section mounting plates. The springs cooperate to normally urge the cross beam away from the mold cavities, such that the position of the base plates within the mold cavities is maintained upon inversion of the cross beam and mold cavities by the brick molding apparatus.

According to another preferred embodiment of the invention, a mold cavity end spacer is adapted for residing adjacent one of the end plates and between adjacent side plates of the mold cavity to adjust the length of the mold cavity.

According to another preferred embodiment of the invention, a pallet is removably positioned over the open top of the mold cavities, and extends from one end of the mold section to the other to hold the green bricks within the mold cavities upon inversion of the mold section by the brick molding apparatus.

In another embodiment, the invention is an adjustable mold cavity adapted for receiving a clay slug and molding the clay slug into a green brick. The mold cavity includes first and second opposing spaced-apart end plates forming respective end walls of the mold cavity. The end plates are spaced-apart a distance defining a length of the mold cavity. First and second opposing spaced-apart side plates are perpendicularly disposed between the opposing end plates and form respective side walls of the mold cavity. The side plates are spaced-apart a distance defining a width of the mold cavity. An adjustable base plate is positioned between the end plates and the side plates to form a bottom wall of the mold cavity. The base plate is spaced-apart from an open top of the mold cavity a distance defining a depth of the mold cavity. The adjustable base plate is adapted for movement relative to the end and side plates to adjust the desired depth of the mold cavity.

BRIEF DESCRIPTION OF THE SEVERAL VIEWS OF THE DRAWINGS

Some of the objects of the invention have been set forth above. Other objects and advantages of the invention will appear as the description proceeds when taken in conjunction with the following drawings, in which.

DETAILED DESCRIPTION OF THE INVENTION

Figure 1:
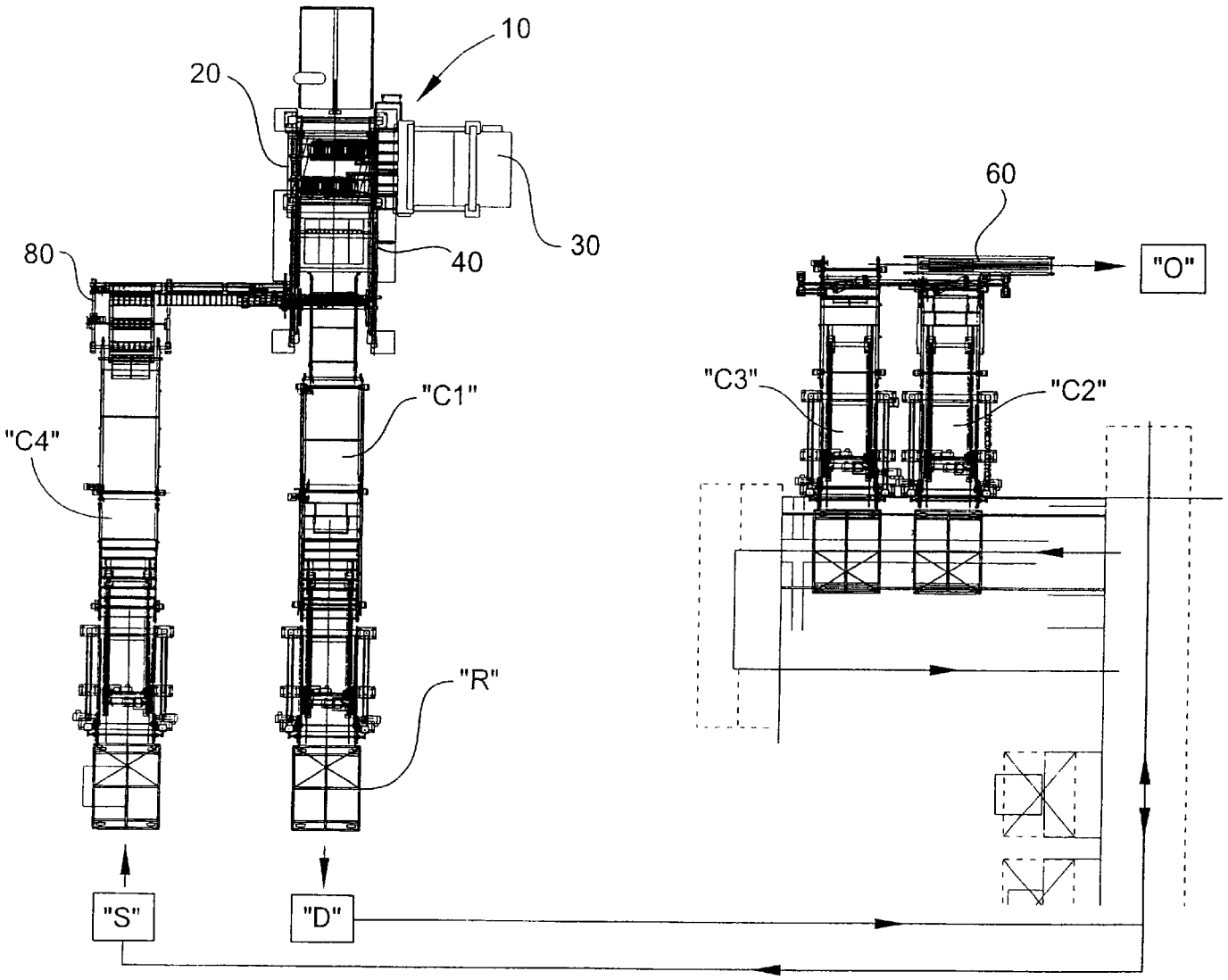
FIG. 1 is a plan view of a brick molding facility employing a brick molding apparatus according to one preferred embodiment of the invention.

Referring now specifically to the drawings, a brick molding apparatus according to the present invention is illustrated in FIG. 1 and shown generally at reference numeral 10. The brick molding apparatus 10 is especially applicable for manufacturing bricks which resemble a traditional hand-thrown product.

Overview of Brick Molding Process

As shown in FIG. 1, the brick molding apparatus 10 includes a clay extrusion assembly 20 which receives clay from a conveyor (not shown), extrudes the clay, and applies wet sand delivered from a wet sand supply assembly 30. The extruded clay is then cut into slugs and thrown into respective cavities of a mold conveyor 40. The mold conveyor 40 transfers the molded clay slugs on a pallet to a chain conveyor "C1". The chain conveyor "C1" moves the pallets downstream away from the mold conveyor 40 for the loading into transport racks "R". The transport racks "R" pass through a dryer room "D" and over to conveyor "C2" where the pallets are removed from the racks "R". Conveyor "C2" moves the loaded pallets to a brick stripper station 60 where the dried bricks are unloaded and transferred to an oven "O" for final processing. The empty pallets are then transferred onto conveyor "C3" and moved downstream for re-loading into the transport racks "R". The transport racks "R" move the empty pallets to a storage area "S". From the storage area "S", the empty pallets are transported to a chain conveyor "C4" which moves the pallets to a pallet inversion station 80. In the pallet inversion station 80, the pallets are inverted and returned to the mold conveyor 40.

Clay Preparation and Delivery

Figure 3:
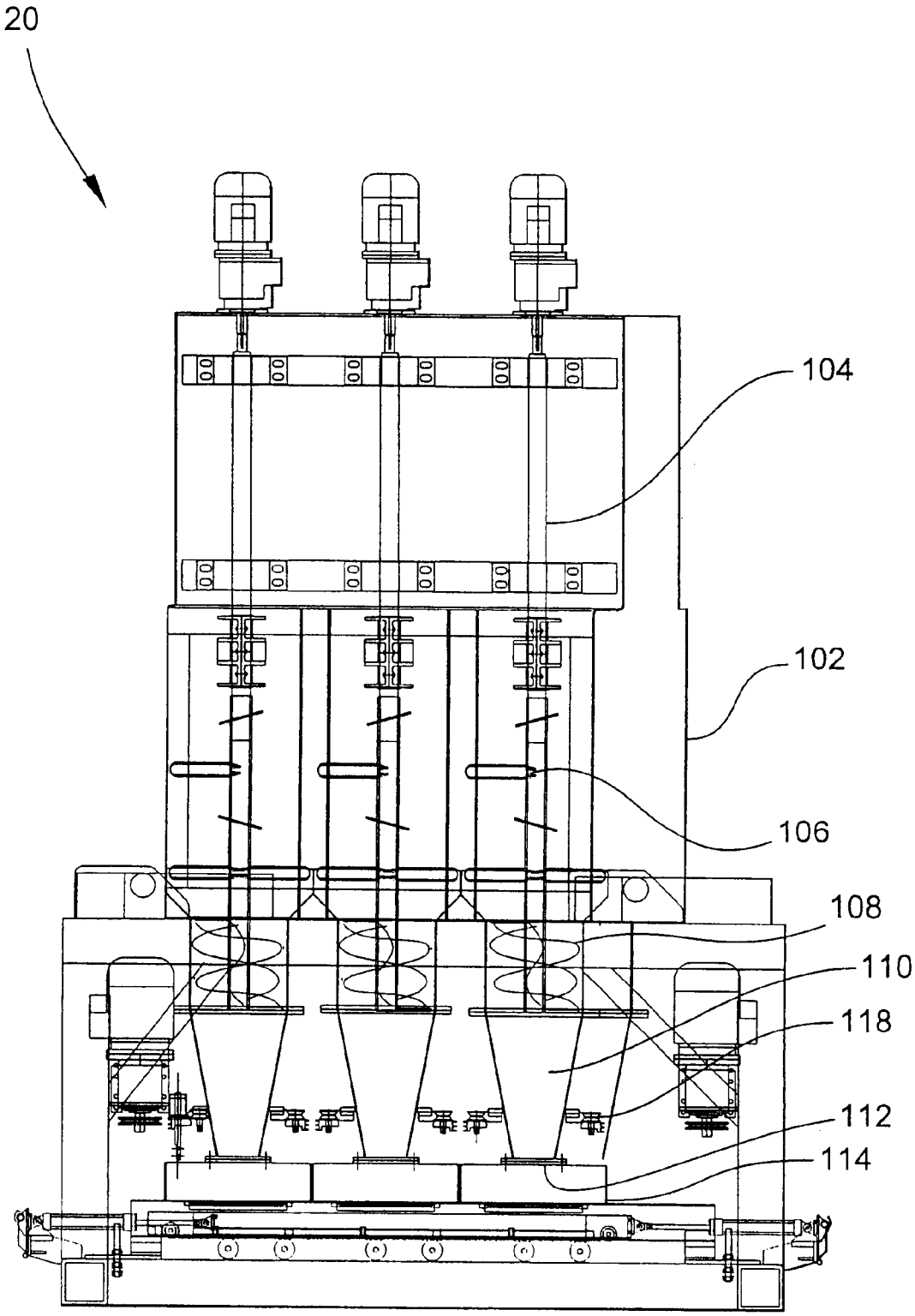
FIG. 3 is a side elevation of the clay extrusion assembly.

Clay used in the brick molding process of the present invention is first processed in a grinding room and then delivered to a clay storage bin upstream of first and second pug mills (not shown). Each pug mill includes a mixing housing jacketed by a steam-heated chamber, and a centrally-disposed longitudinal rotating shaft and paddle assembly. As clay is fed from the storage bin into the first pug mill, warm water is added to the clay while the paddle assembly mixes the clay and water to the proper consistency at the selected temperature maintained by the outer steam chamber. The clay/water mixture passes through both pug mills, and is moved by a conveyor to a clay hopper 102 of the extrusion assembly 20 shown in FIG. 3. Six motor-driven rotating shafts 104 (only three shown) are longitudinally-disposed within the clay hopper 102, and include respective mixing paddles 106 operating to maintain proper consistency of the of the clay mix prior to extruding. The terminal end each shaft 104 defines a longitudinal auger 108 which receives and moves the clay mix downwardly through an extruder head 110 and outwardly from a first forming die 112 positioned above a wet sand tub 114. The extrusion assembly 20 preferably includes six extruder heads 110 and six wet sand tubs 114 arranged in two rows of three.

Wet Sand Storage and Delivery

Figure 4:
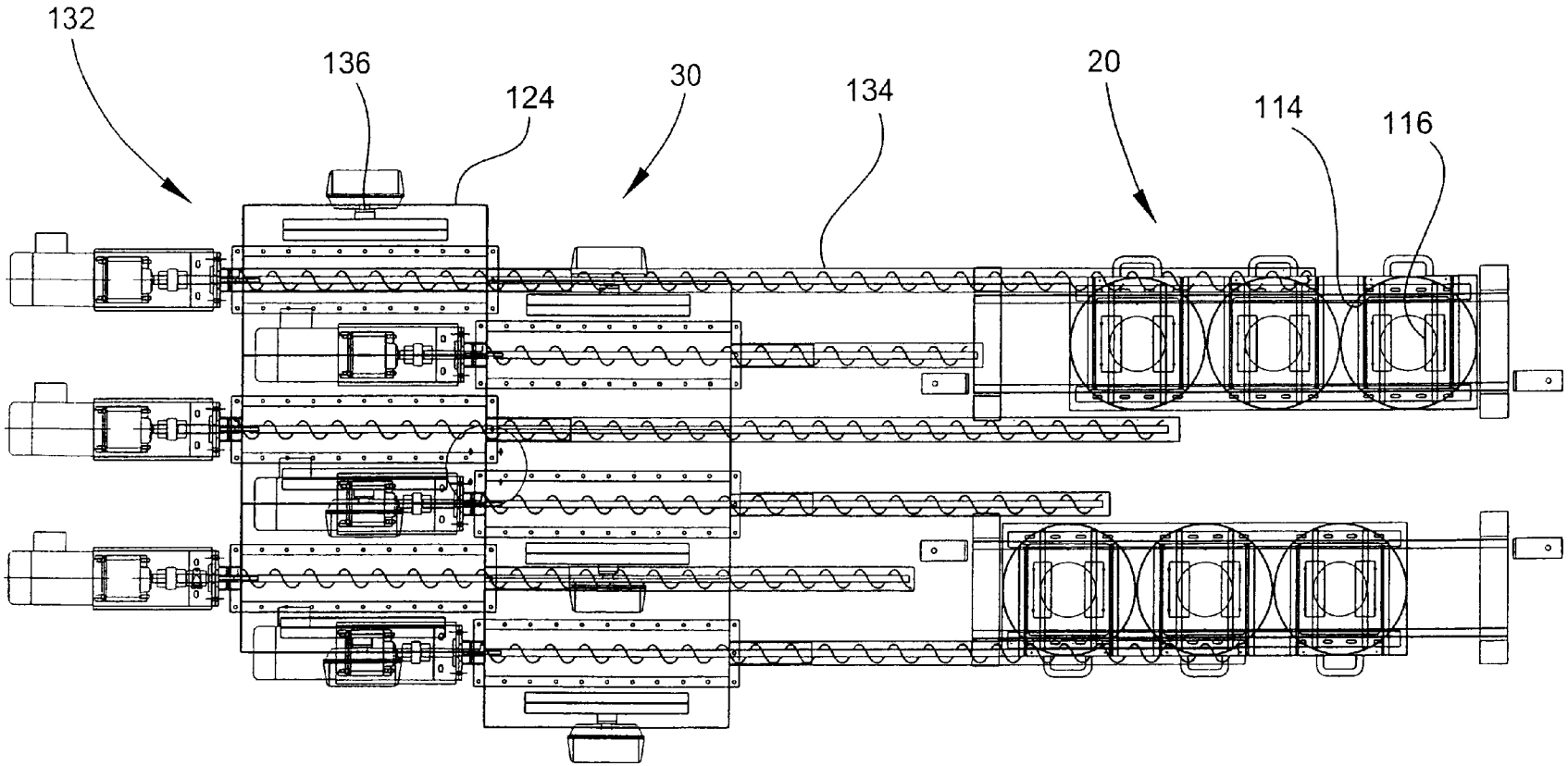
FIG. 4 is a top plan view of the wet sand supply system illustrating delivery of wet sand to the sand tubs of the clay extrusion assembly.

The clay mix exits each of the six extruder heads 110 and forming dies 112 (only three shown) in the shape a continuous length column, and is further shaped by a flexible rubber die 116 formed with a center opening through each of the wet sand tubs 114, as shown in FIG. 4. Wet sand contained in the sand tubs 114 is applied to each of the moving clay columns by means of respective rotary extrusion processing assemblies 118, described below. In order to maximize its flexibility of operation, each of the six extruder heads 110 of the brick molding apparatus 10 must be capable of producing a different colored brick. To achieve this, each extruder head 110 is served by its own wet sand supply to the sand tub 114.

Figure 2:
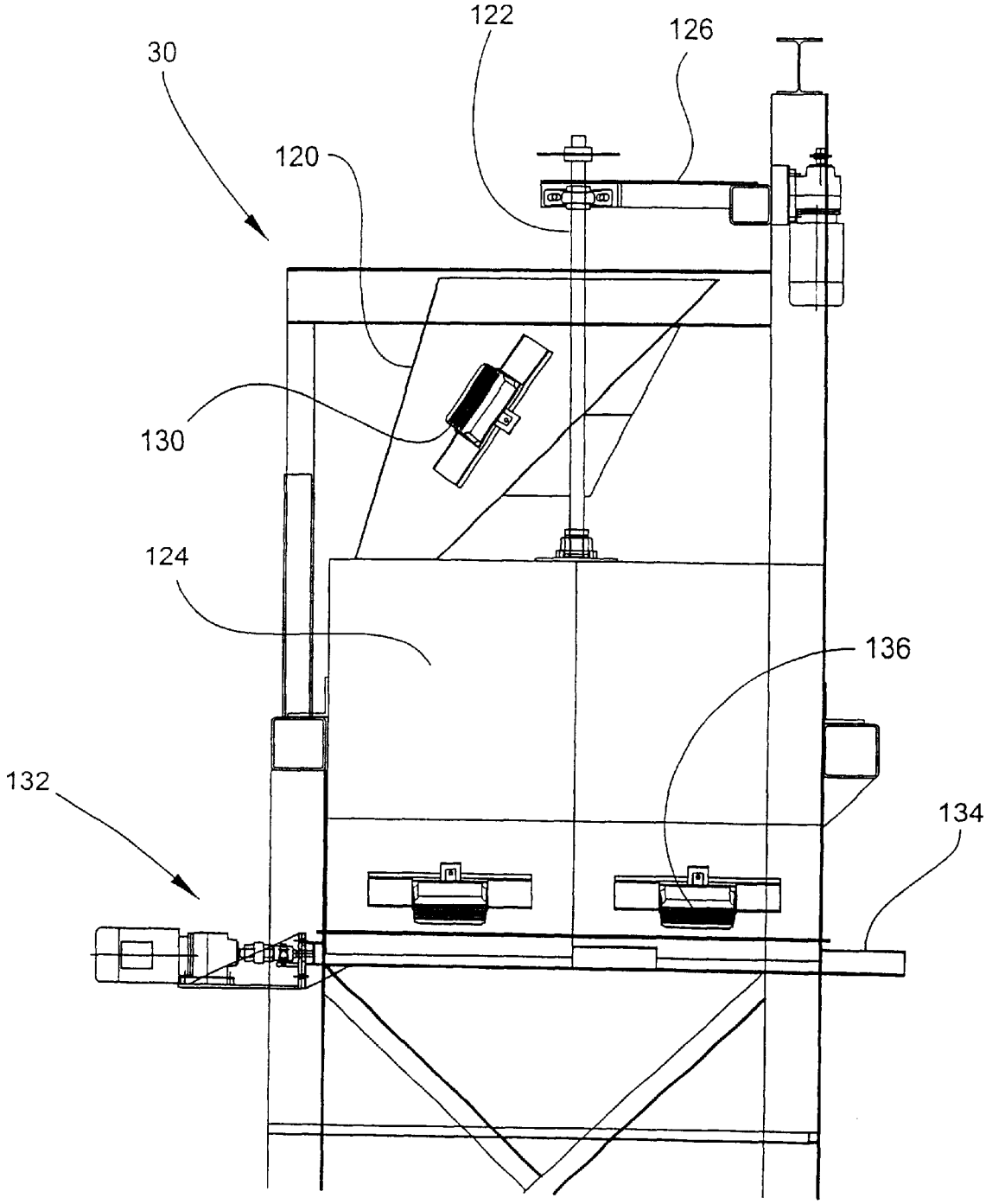
FIG. 2 is a side elevation of the wet sand supply assembly located adjacent the clay extrusion assembly of the brick molding apparatus.

Referring to FIGS. 2 and 4, the wet sand supply assembly 30 is located adjacent the clay extrusion assembly 20, and includes an asymmetrical sand delivery cone 120 rotatably mounted to a vertical drive shaft 122 extending above six divided wet sand hoppers 124. The drive shaft 122 is powered by a drive chain 126 and cone motor 128. Actuation of the drive shaft 122 rotates the sand delivery cone 120 through a 360-degree path such that the feed end of the cone 120 can be positioned over each of the six wet sand hoppers 124. A vibrator 130 is preferably mounted to the exterior of the sand delivery cone 120 to promote the flow of wet sand outwardly through the feed end and into the selected wet sand hopper 124. As shown in FIGS. 2 and 4, a rotary conveyor assembly 132 is located at the base of the wet sand hoppers 124, and includes six rotary augers 134 arranged at the open bottom of the sand hoppers 124 and extending horizontally to respective wet sand tubs 114 positioned beneath the extruder heads 110. The rotary augers 134 operate to transport the wet sand exiting the sand hoppers 124 to the wet sand tubs 114. Preferably, vibrators 136 are mounted to each of the sand hoppers 124 to promote the flow of wet sand outwardly to the rotary augers 134 and to prevent the occurrence of sand "bridging".

Rotary Extrusion Processing Assembly 118

Figure 5:
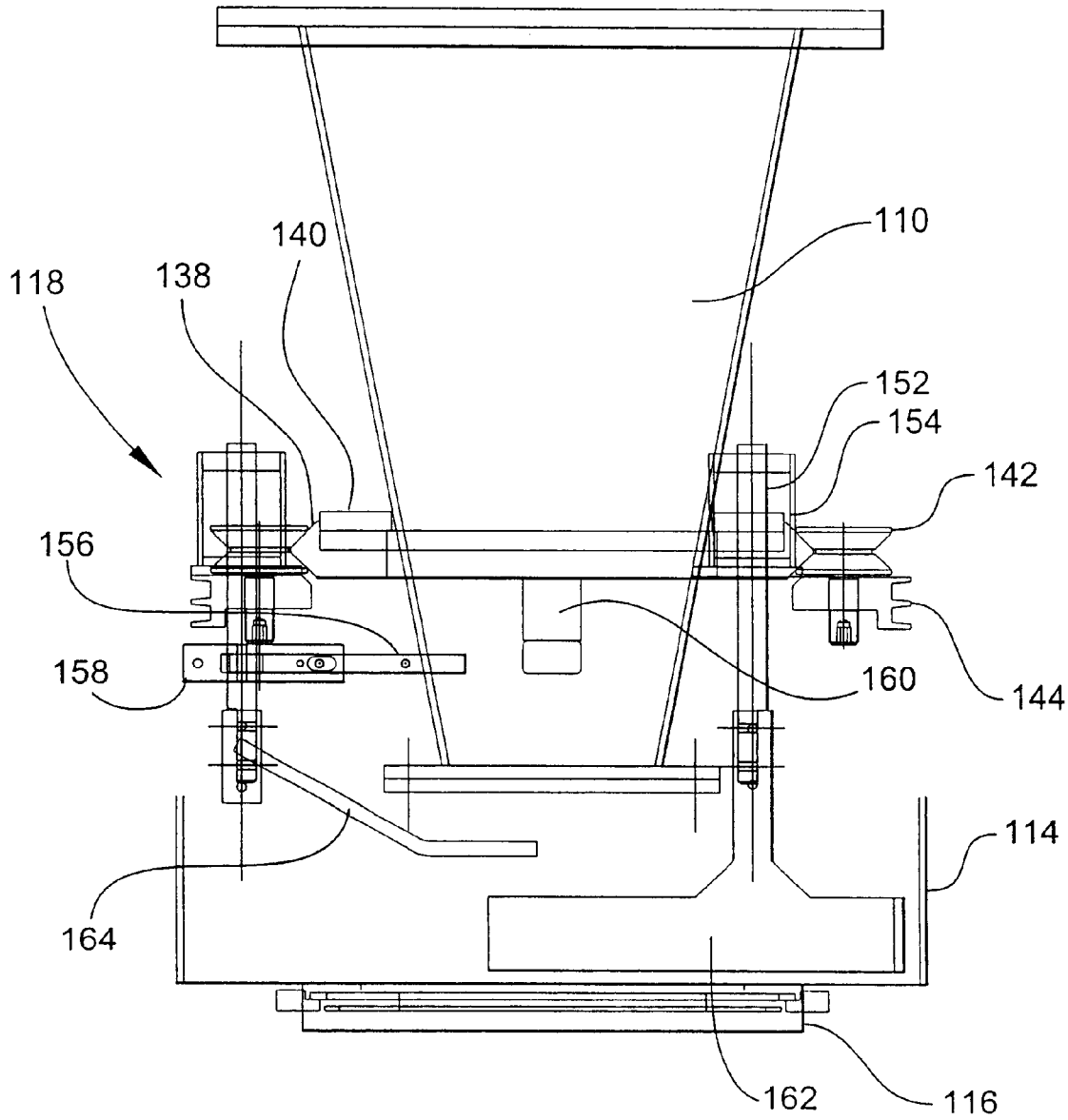
FIG. 5 is a side elevation of an extruder head and showing the attached rotary extrusion processing assembly.
Figure 6:
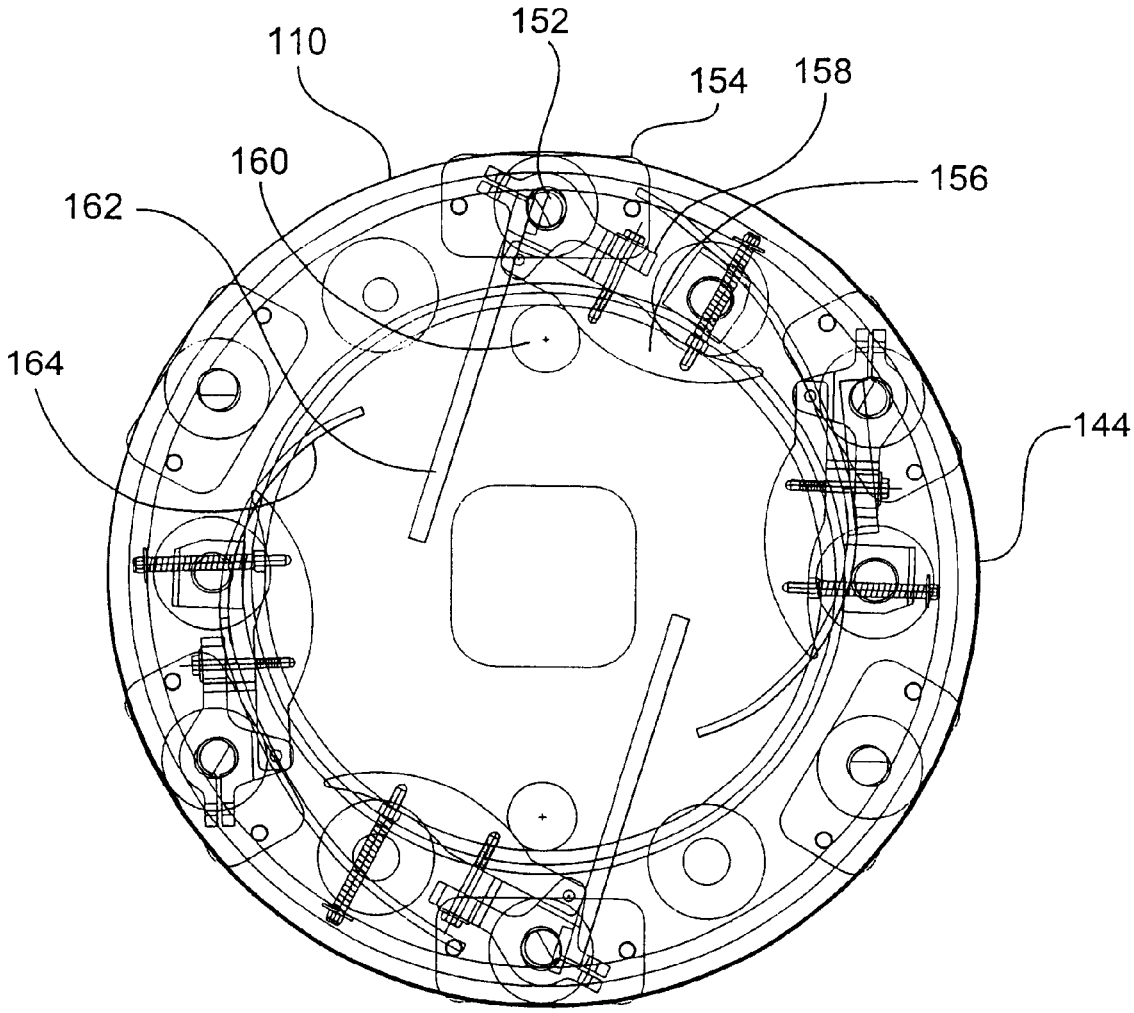
FIG. 6 is a top plan view of the extruder head and attached rotary extrusion processing assembly.
Figure 7:
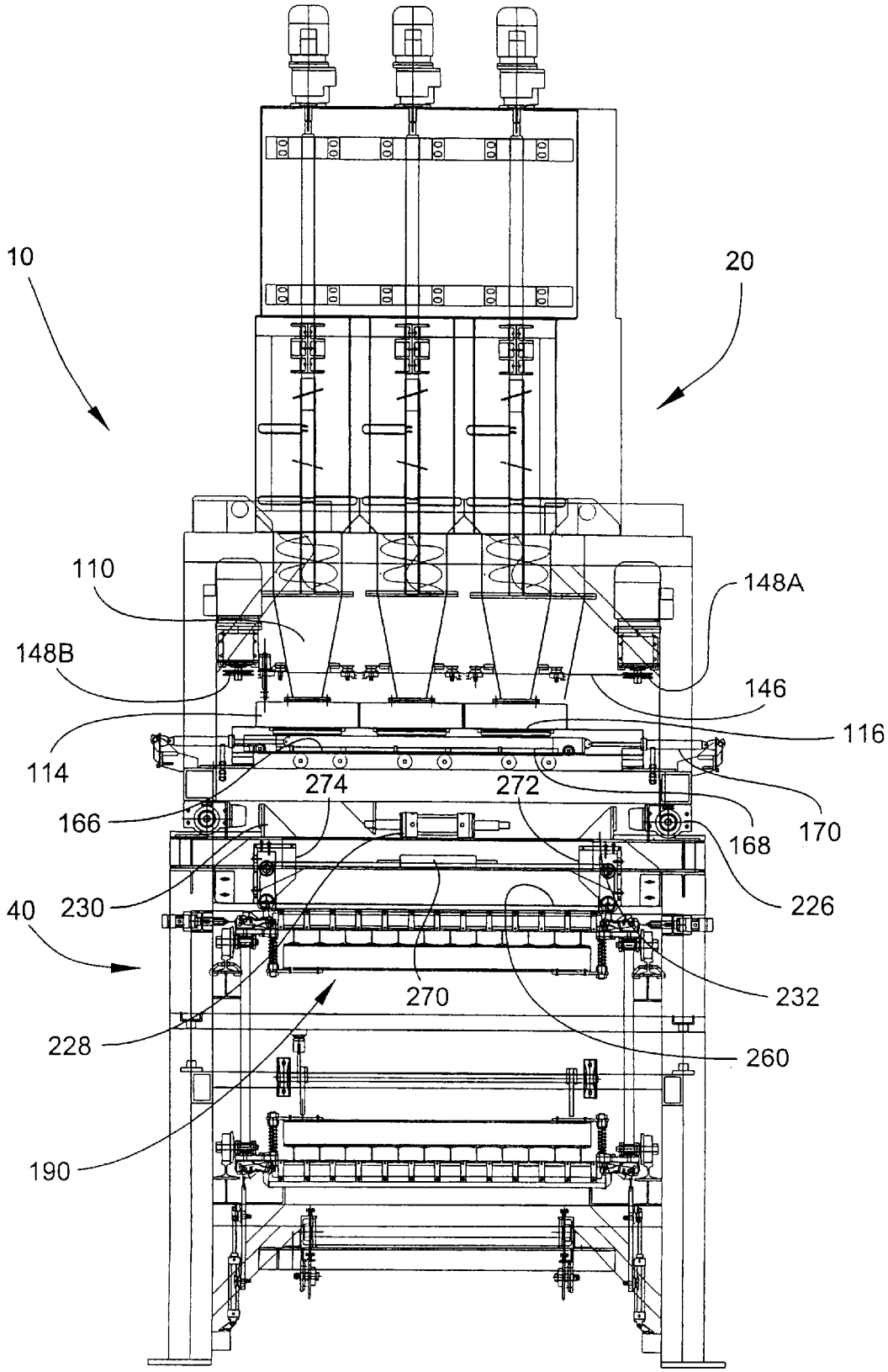
FIG. 7 is an end elevation of the brick molding apparatus with the throw belts removed for clarity.

Referring to FIGS. 5, 6, and 7, a rotary extrusion processing assembly 118 is provided for each of the six extruder heads 110 to mark and further process the moving clay extrusion. Each assembly 118 includes a stationary roller track 138 fixed to an annular mounting flange 140 welded to the exterior of the extruder head 110. A number of spaced-apart V-grooved roller runners 142 are carried on the track 138, and attached to an annular double-grooved revolving sheave 144. The runners 142 are preferably spaced-apart evenly around the circumference of the roller track 138, and are adapted for being actuated by respective drive belts 146 positioned within the grooves and extending laterally from one side of the clay extrusion assembly 20 to the other. The drive belts 146 are operatively connected to opposing drive pulleys 148A and 148B, shown in FIG. 7. As previously indicated, the clay extrusion assembly 20 includes two rows of three laterally-spaced extruder heads 110. Thus, a first assembly of drive belts 146 and pulleys 148A, 148B serves to actuate the revolving sheave 144 on each of the first row of extruder heads 110, while a second assembly of drive belts 146 and pulleys 148A, 148B actuates the revolving sheave 144 on each of the second row of extruder heads 110. The drive pulleys 148A, 148B cooperate to move the revolving annual sheave 144 360-degrees around the circumference of each of the roller tracks 138 of the extruder heads 110.

The revolving annular sheave 144 carries any number of pivotable cam shafts 152 vertically mounted within a bearing box 154 and extending downwardly through the revolving sheave 144 towards the sand tub 114. A cam arm 156 is attached to a cam body clamp 158 mounted to the pivotable cam shaft 152 below the revolving sheave 144, and is spring loaded to normally urge the cam arm 156 inwardly towards the center of the extruder head 110. Any number of stationary arm-engaging posts 160 are mounted to the underside of the roller track 138, and extend downwardly to operatively engage the cam arms 156 upon movement of the revolving sheave 144 along the circumference of the roller track 138. One or more radially-extending clay-processing tools, such as a sand spoon 162 and clay probe 164, is attached to a terminal end of the cam shaft 152, and is actuated upon pivoting movement of the shaft 152 caused by engagement of the spring-loaded cam arm 156 and posts 160. As the cam arm 156 engages the post 160, the tool 162, 164 is forced in a direction towards the extruded clay column passing centrally through the second forming die 116 in the sand tub 114. The sand spoon 162 is adapted for scooping together and applying the wet sand contained in the sand tub 114 onto the moving clay column. The sand spoons 162 are preferably spaced 180 degrees apart along the circumference of the roller track 138. The clay probes 164 are preferably attached to each of the remaining cam shafts 152. The clay probes 164 are adapted to intermittently engage the moving clay column in a manner creating impressions which result in unique identification patterns in the finished brick.

Clay Slug Formation and Throw

Figure 8:
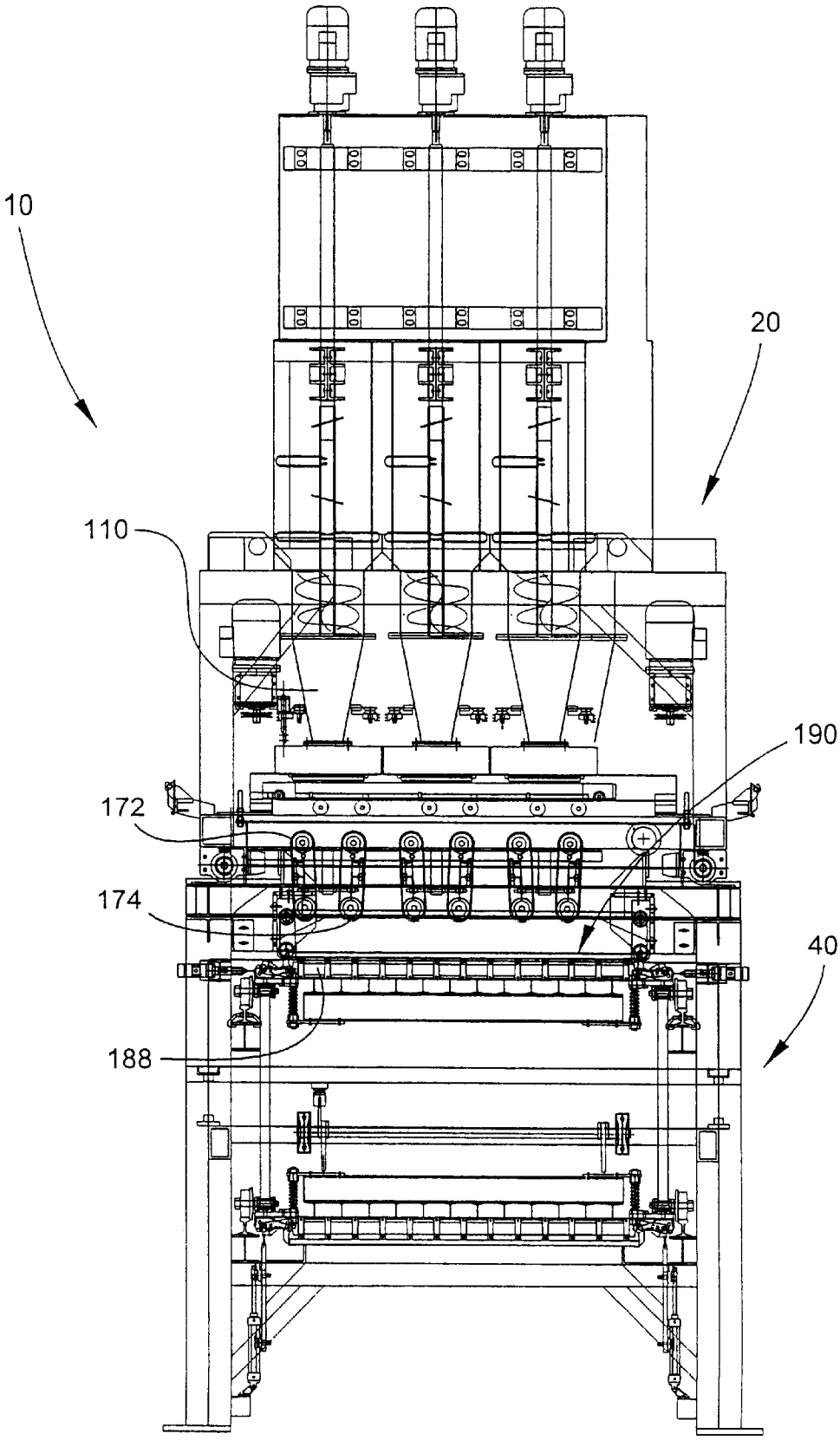
FIG. 8 is an end elevation of the brick molding apparatus with the throw belts included.
Figure 9:
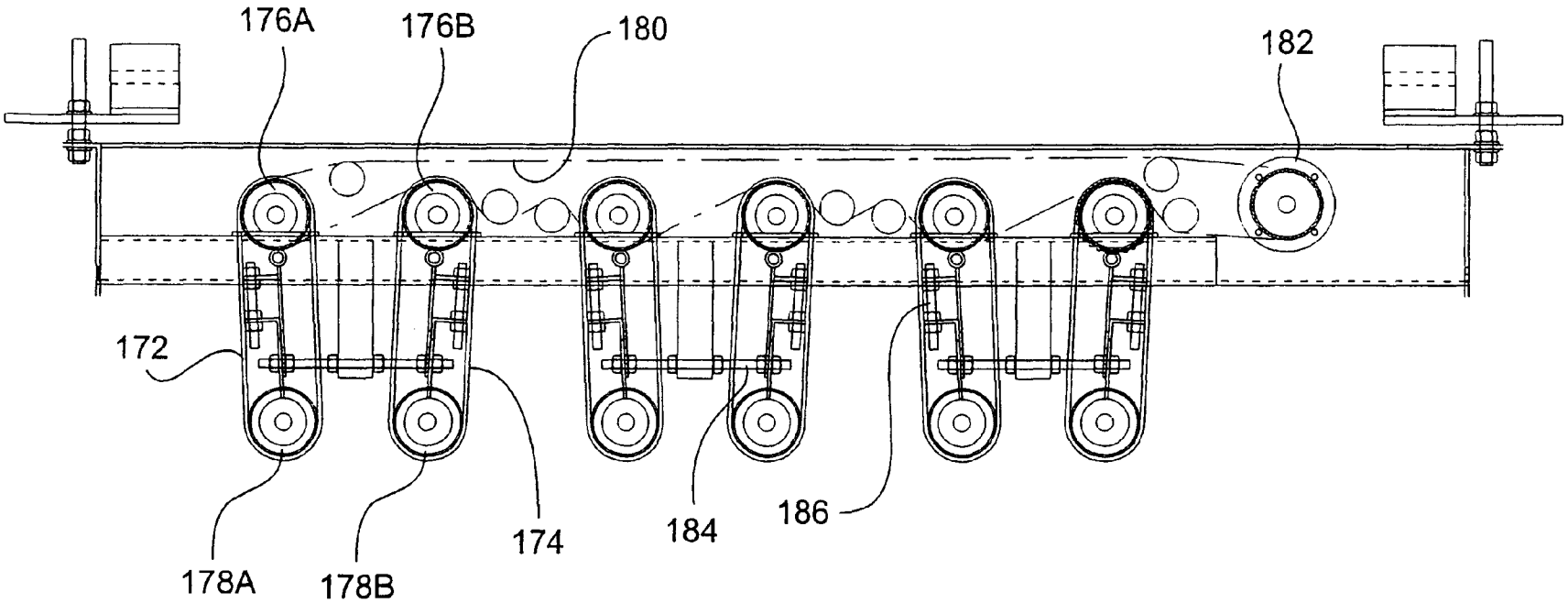
FIG. 9 is an elevational view of the throw belts.

Referring to FIGS. 7, 8, and 9, as the moving clay column exits the wet sand tub 114 through the second forming die 116, the column is cut laterally into brick-sized slugs by a lateral moving cutting wire 166. The cutting wire 166 is carried by a trolley 168 actuated by a trolley cylinder 170. Once cut, the clay slugs drop vertically between opposing, counter-rotating throw belts 172 and 174 which cooperate to "throw" the brick slug downwardly into a mold cavity of the mold conveyor 40 located below. As best shown in FIGS. 8 and 9, the throw belts 172, 174 are carried on respective drive rollers 176A, 176B and idle rollers 178A, 178B. The drive rollers 176A, 176B for each section of throw belts 172, 174 are interconnected and powered by a single drive chain 180 and motor 182. Preferably, the spacing of the lower idle rollers 178A, 178B of each pair of throw belts 172, 174 is readily adjustable using a threaded adjustment screw 184. This adjustment allows the user to either change the landing point of the slug in a given mold cavity to assure proper coverage, or to shape the slug to achieve a desired effect on the finished brick. In addition, the vertical spacing between the rollers 176A, 176B and 178A, 178B may also be adjusted using tension adjustment screws 186 to account for stretching of the throw belts 172, 174 over time. According to one embodiment, the throw belts 172, 174 are approximately four inches wide and eighteen inches long, respectively, and are spaced about four inches apart.

Mold Conveyor and Filling Station

Referring to FIGS. 8, 10, 10A, and 11, from the throw belts 172, 174, the brick slugs are delivered into respective mold cavities 188 of the mold conveyor 40. According to one embodiment, the mold conveyor 40 includes 40 12-cavity adjustable elongate mold sections 190 attached at respective opposite ends to continuous-loop drive chains 192 (See FIG. 12) located at opposite sides of the mold conveyor 40. While the following description refers to only a single mold section 190, it is understood that the remaining mold sections are identical in construction and operate in an identical manner to that described.

Figure 10:
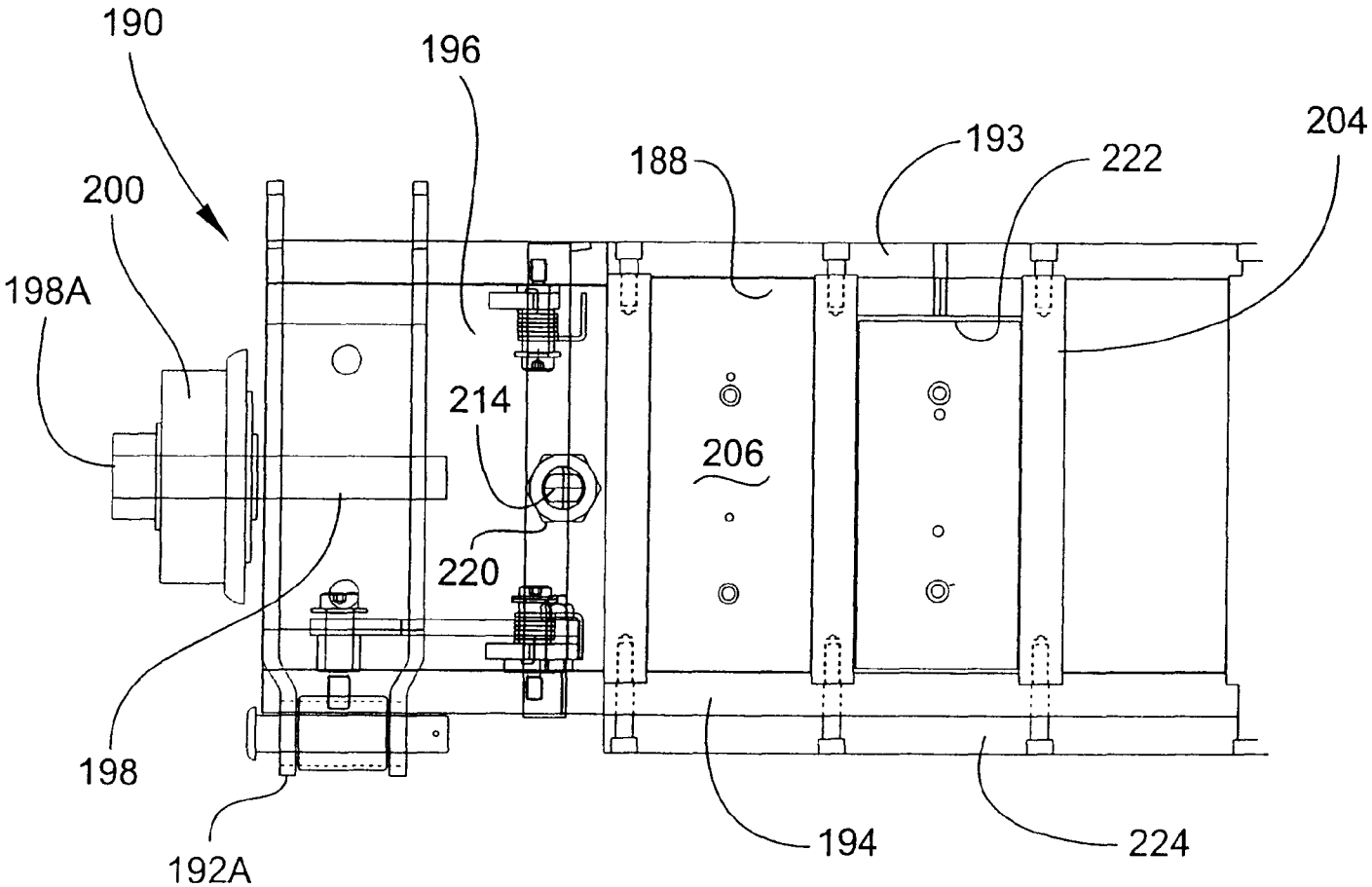
FIG. 10 is a fragmentary top plan view of a portion of the mold section.
Figure 10A:
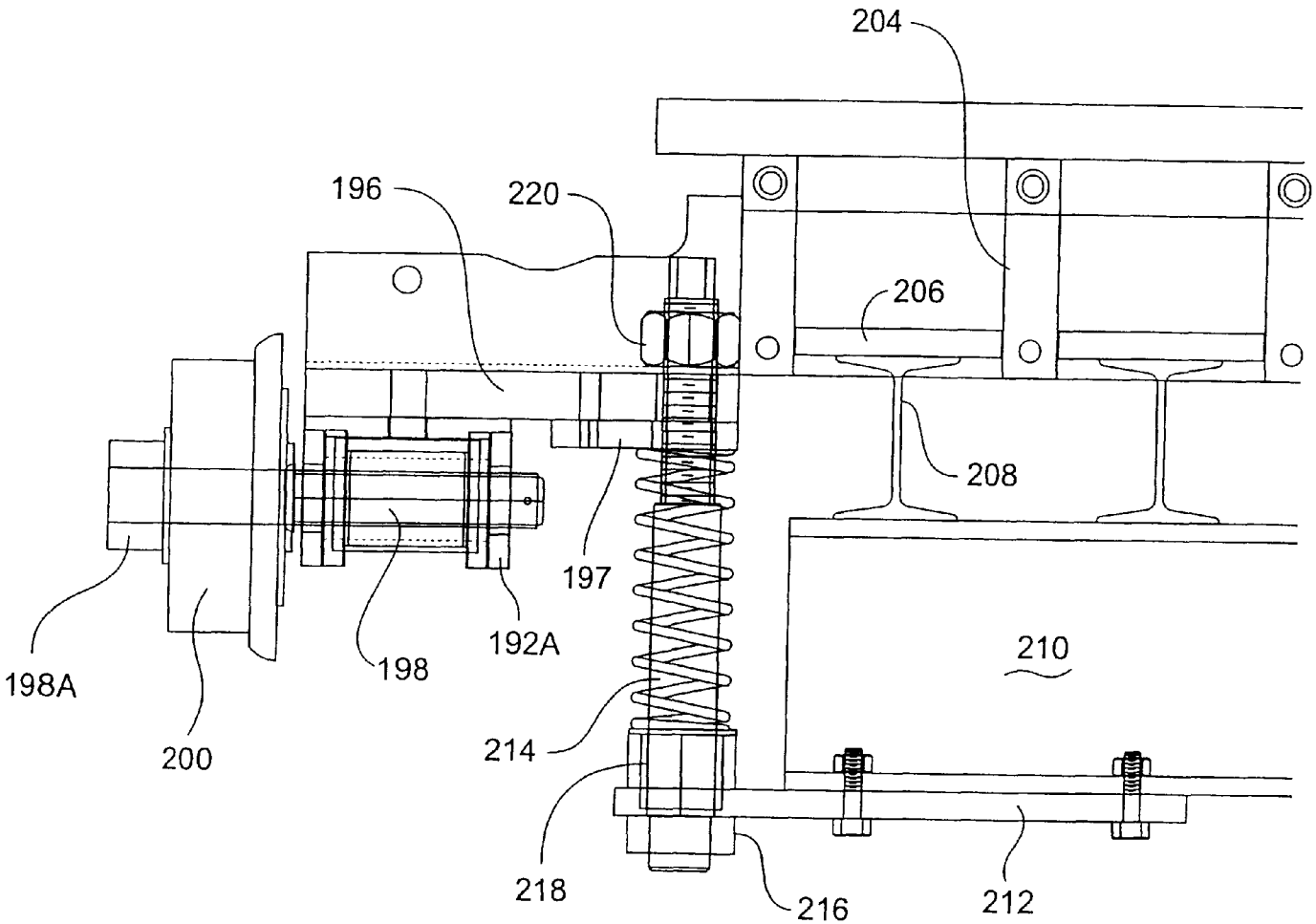
FIG. 10A is an enlarged, fragmentary side elevation showing one end of a portion of the mold section.

As shown in FIG. 10, the mold section 190 includes opposing, spaced-apart, longitudinal end plates 193 and 194 extending the entire length of the mold section 190, and defining respective opposing end walls of the mold cavities 188. The end plates 193 and 194 are joined at respective opposite ends to mold section mounting plates 196 (only one shown). Each mounting plate 196 is secured by axial bolt 198 to a chain link 192A of the drive chain 192. A guide wheel 200 is located between the head 198A of the bolt 198 and the chain link 192A to engage the outer guide rail 202 of the mold conveyor 40 during operation. The mold cavities 188 are further defined by a plurality of side plates 204 attached to each of the end plates 193 and 194, and spaced-apart a predetermined distance to define opposing side walls of each mold cavity 188. As best shown in FIGS. 1OA and 11, the bottoms of the mold cavities 188 are formed by respective base plates 206 mounted to respective base beams 208. The short base beams 208 are carried by a single cross beam 210 ending from one end of the mold section 190 to the other, and including respective opposing cross beam mounting plates 212 cooperating with spring-loaded guide shafts 214 to support the cross beam 210 a predetermined distance from the mold cavities 188. The guide shafts 214 are threaded at respective top ends, and are secured to the cross beam mounting plates 212 at their respective bottom ends using fixed shaft collars 216 and bushings 218. The threaded top ends of the guide shafts 214 extend through respective internally-threaded openings of keeper plates 197, and through respective openings in the mounting plates 196. The guide shafts 214 are secured to the mold section mounting plates 196 using complementary-threaded lock nuts 220. Releasing the lock nut 220 of each guide shaft 214 allows ready and convenient depth adjustment of the mold cavities 188 by enabling threaded vertical movement of the guide shaft 214 to manipulate the position of the base plate 206 relative to the end plates 193, 194 and side plates 204. The length of each mold cavity is defined by the distance between the end plates 193 and 194, and is likewise conveniently adjusted by inserting metal spacers 222 between the adjacent side plates 204. The width of the mold cavity 188 is defined by the distance between adjacent side plates 204. In addition, to maintain proper spacing between adjacent mold sections 190 during operation of the mold conveyor 40, a frame rail spacer 224 is bolted to a top edge of the end plate 194.

In order to fill all mold cavities 188 of the mold section 190, the extruder heads 110 and throw belts 172 and 174 of the clay extrusion assembly 20 must travel over the mold conveyor 40 to inject a clay slug into each of the empty mold cavities 188. As shown in FIGS. 7 and 8, to achieve this movement, the clay extrusion assembly 20 is mounted on base rollers 226 and actuated by a drive cylinder 228. Opposing travel stops 230 and 232 define maximum lateral movement of the clay extrusion assembly 20 over the mold conveyor 40.

Figure 12:
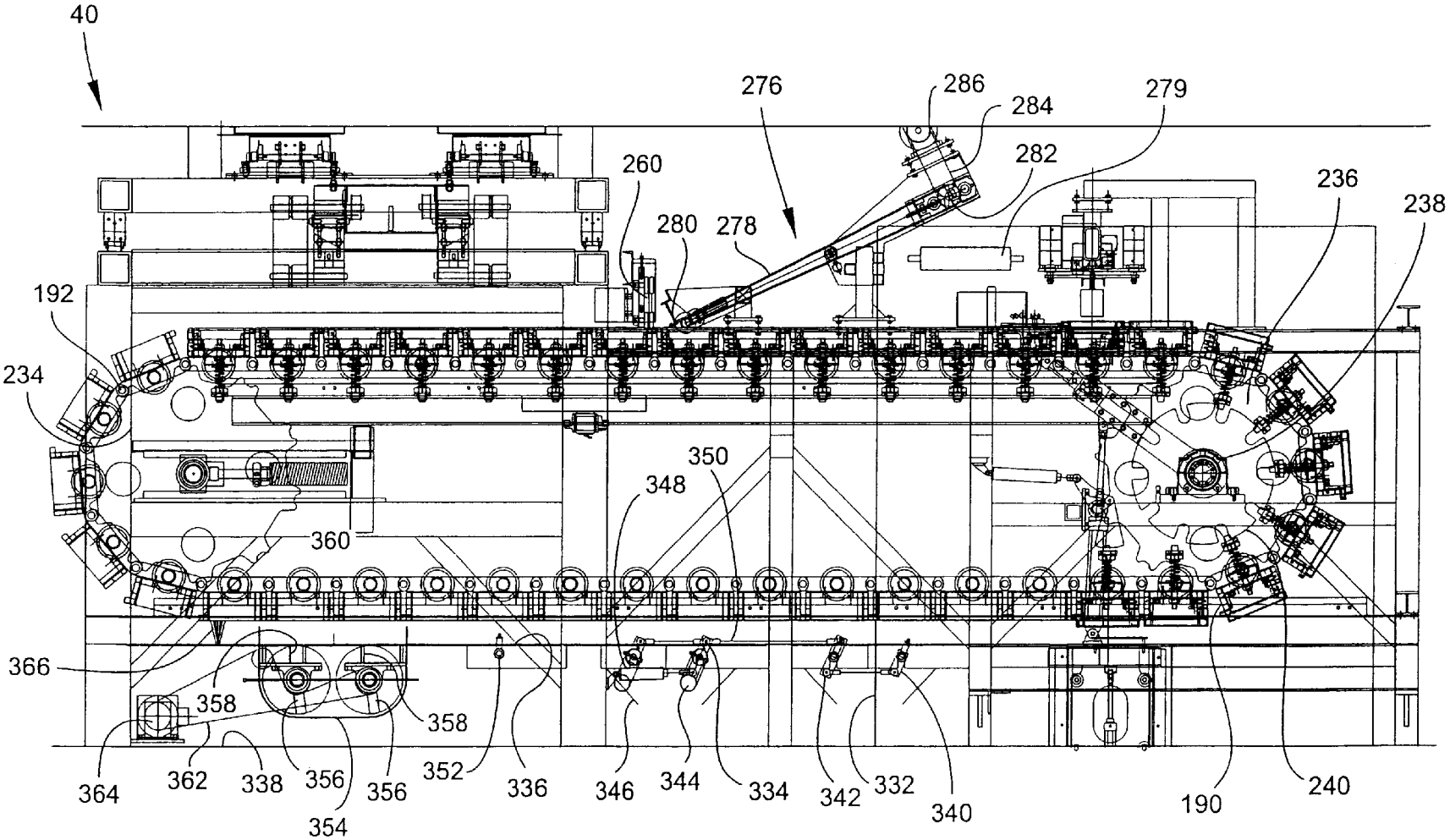
FIG. 12 is a side elevation of the mold conveyor of the brick molding apparatus.

After all cavities 188 of the mold section 190 are filled, the opposing drive chains 192 of the mold conveyor 40 cooperate to move the mold section 190 downstream of the filling station such that an empty mold section 190 can now be filled, as previously described. The drive chains 192 are attached at opposite ends of the mold conveyor 40 to respective first and second pairs of rotating conveyor sprocket wheels 234 and 236, as best shown in FIG. 12. A drive shaft 238 extends through the second pair of conveyor sprocket wheels 236 at the discharge end of the mold conveyor 40, and is operatively connected to a drive ratchet assembly 240 described below.

Figure 13:
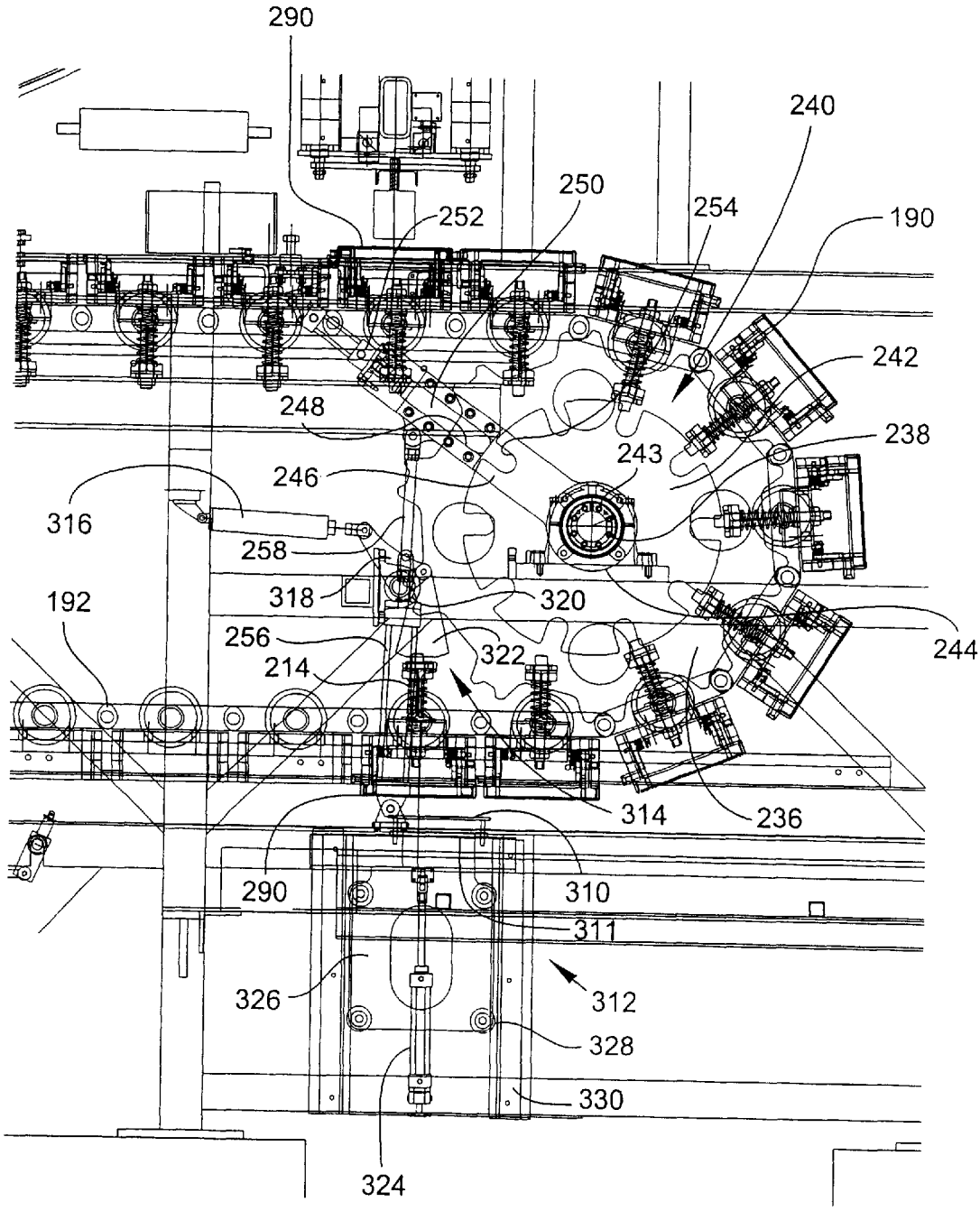
FIG. 13 is a fragmentary elevational view showing the discharge end of the mold conveyor.
Figure 14:
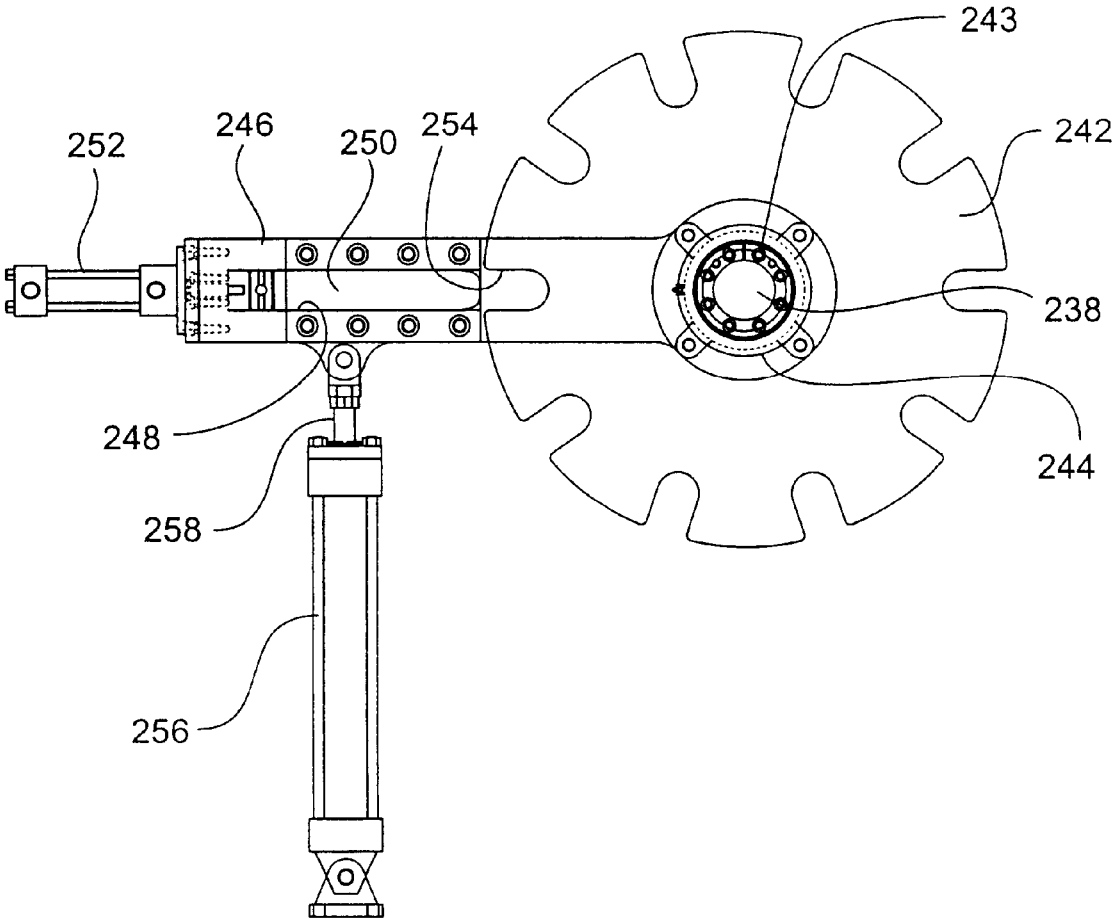
FIG. 14 is an elevational view of the drive gear used for actuating the mold conveyor.
Figure 15:
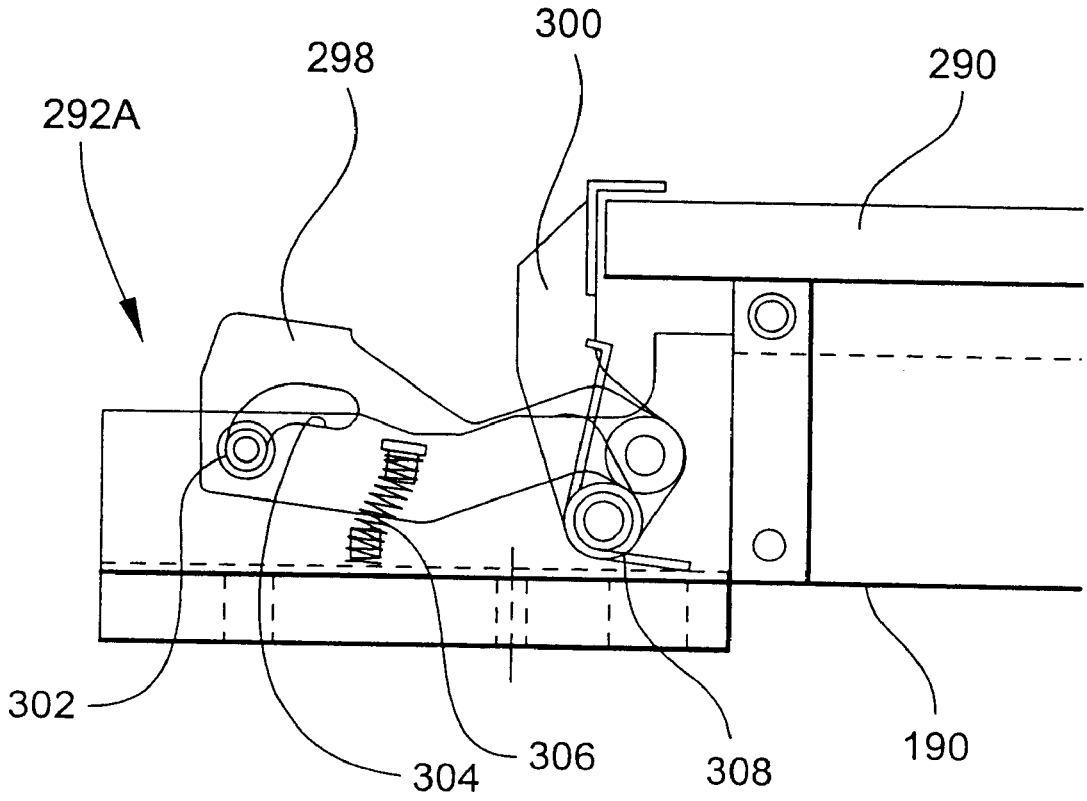
FIG. 15 is an end elevation of a mold section showing the clamping assembly used for clamping the pallet to the mold section.
Figure 16:
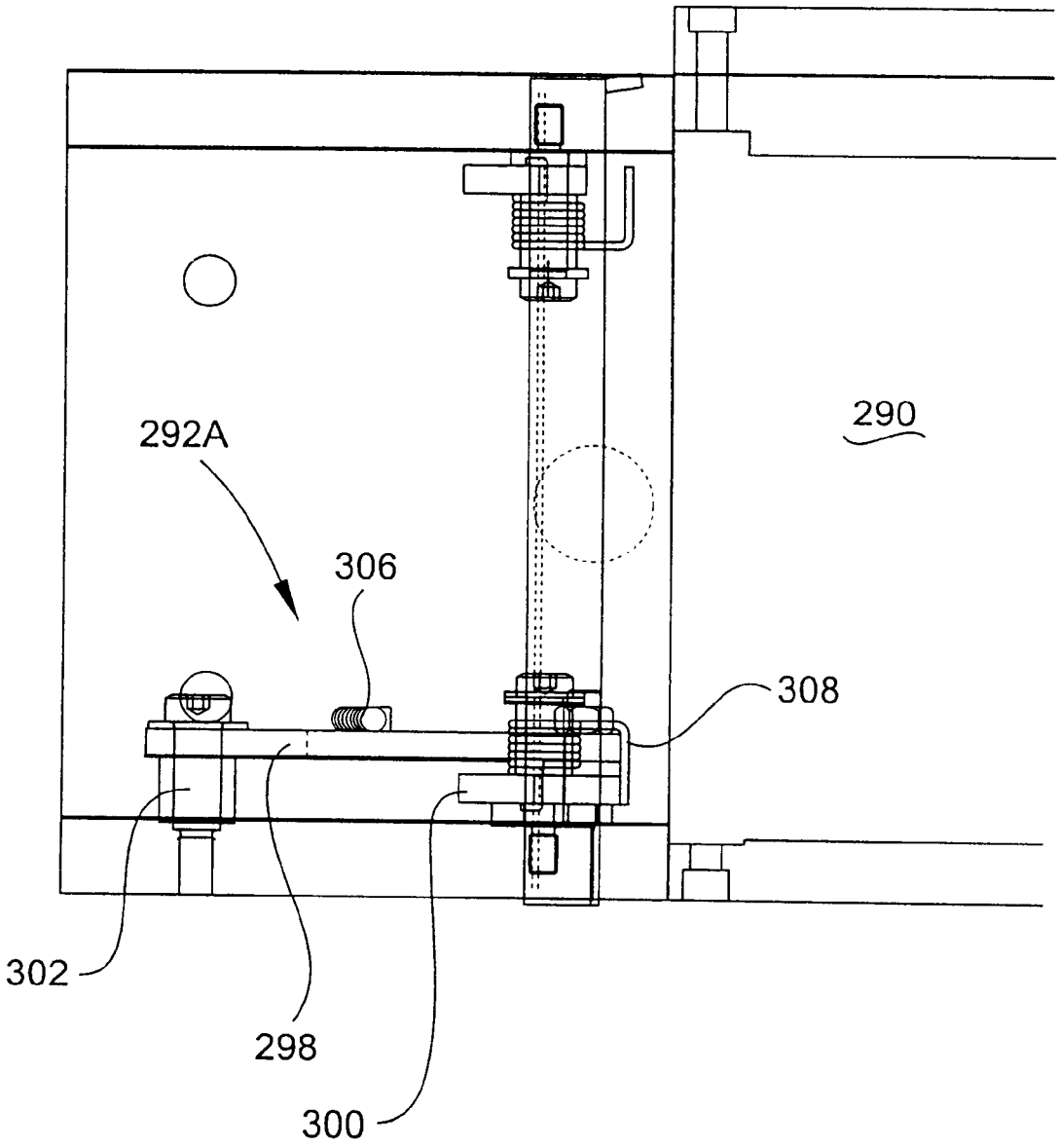
FIG. 16 is a fragmentary top plan view showing one end of a portion of the mold section.
Figure 17:
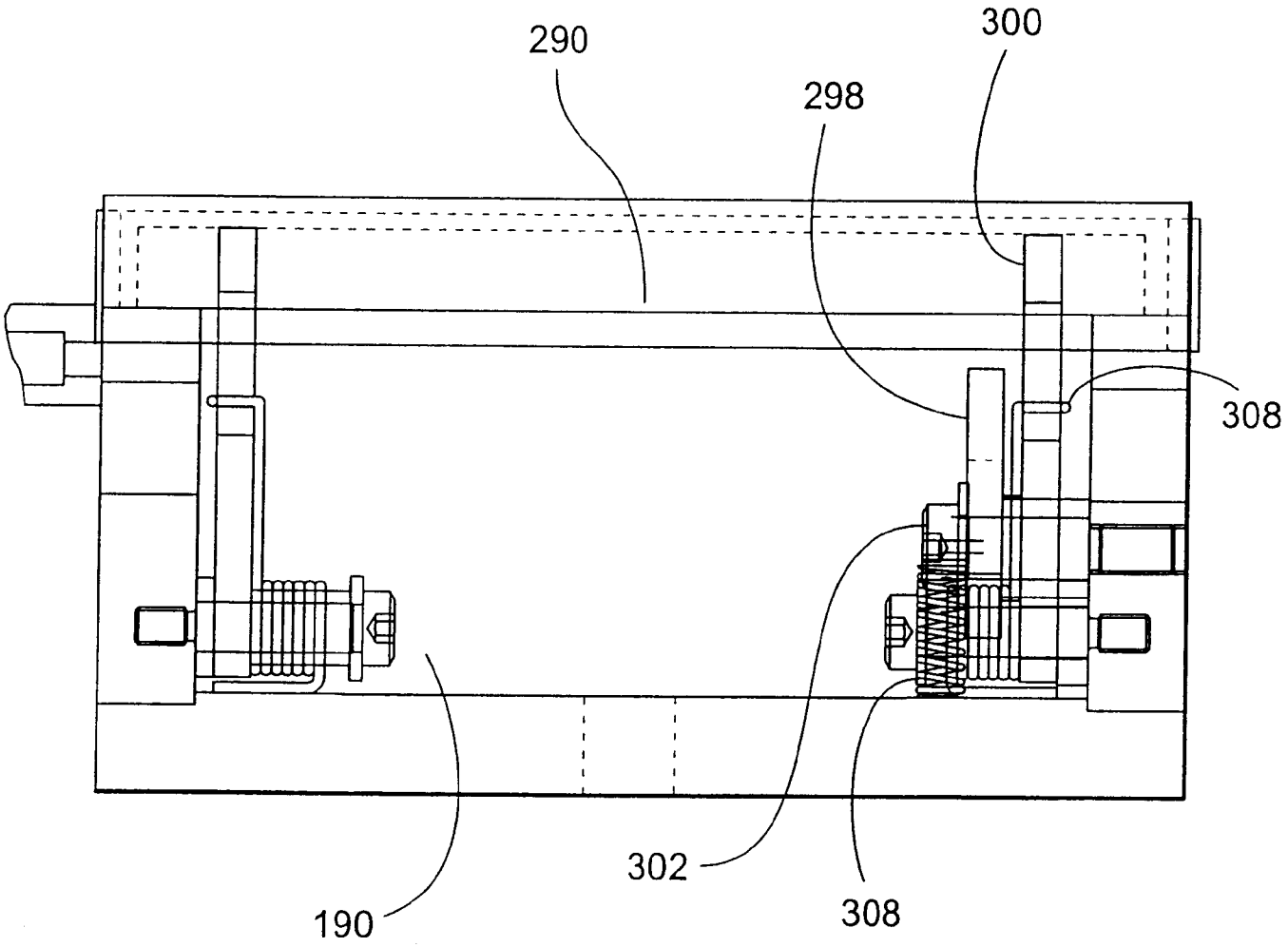
FIG. 17 is a fragmentary side elevation showing one end of a portion of the mold section, and demonstrating operation of the clamping arm for holding the pallet on the mold section.

The drive ratchet assembly 240, best shown in FIGS. 13 and 14, includes a drive gear 242 positioned adjacent the conveyor sprocket wheel 236 and fixed to the drive shaft 238 through a locking collar 243 secured to a bearing 244. A pair of operating arms 246 (only one shown) are attached to the bearing 244 on either side of the drive gear 242, and extend outwardly from the drive shaft 238 a prescribed distance beyond the outside diameter of the drive gear 242. A slot along the length of each operating arm 246 defines a longitudinal lug track 248. The lug track 248 receives a metal drive lug 250 adapted for inward and outward sliding movement within the track 248. The drive lug 250 is powered by an attached drive-lug cylinder assembly 252 mounted on the end of the operating arms 246. The drive-lug cylinder assembly 252 includes an extendable/retractable piston which operates to move the drive lug 250 between a retracted position, wherein the drive lug 250 is fully positioned within the track 248, and an extended position, wherein the drive lug 250 enters into one of a plurality of radial slots 254 formed between respective adjacent teeth of the drive gear 242. A master drive cylinder assembly 256 is mounted on the conveyor frame, and includes an extendable/retractable piston 258 attached to the underside of the operating arms 246.

Movement of the mold conveyor 40 is effected by first actuating the drive-lug cylinder assembly 252 to move the drive lug 250 into the extended position within a slot 254 of the drive gear 242. With the drive lug 250 in the extended position, the master drive cylinder assembly 256 is then actuated to move the piston 258 outwardly, thereby advancing the drive gear 242 a predetermined angular distance. As the drive gear 242 advances, the fixed drive shaft 238 rotates causing rotation of the attached conveyor sprocket wheels 234 and 236 and drive chains 192. The drive chains 192 cooperate to index the mold section 190 downstream in a clockwise direction away from the mold filling station. Preferably, a compact roller (not shown) located adjacent the mold filling station rolls over the open top of the mold section 190 to help assure that all corners of the mold cavities 188 are properly filled.

Overfill Cutoff and Removal Station

Figure 11:
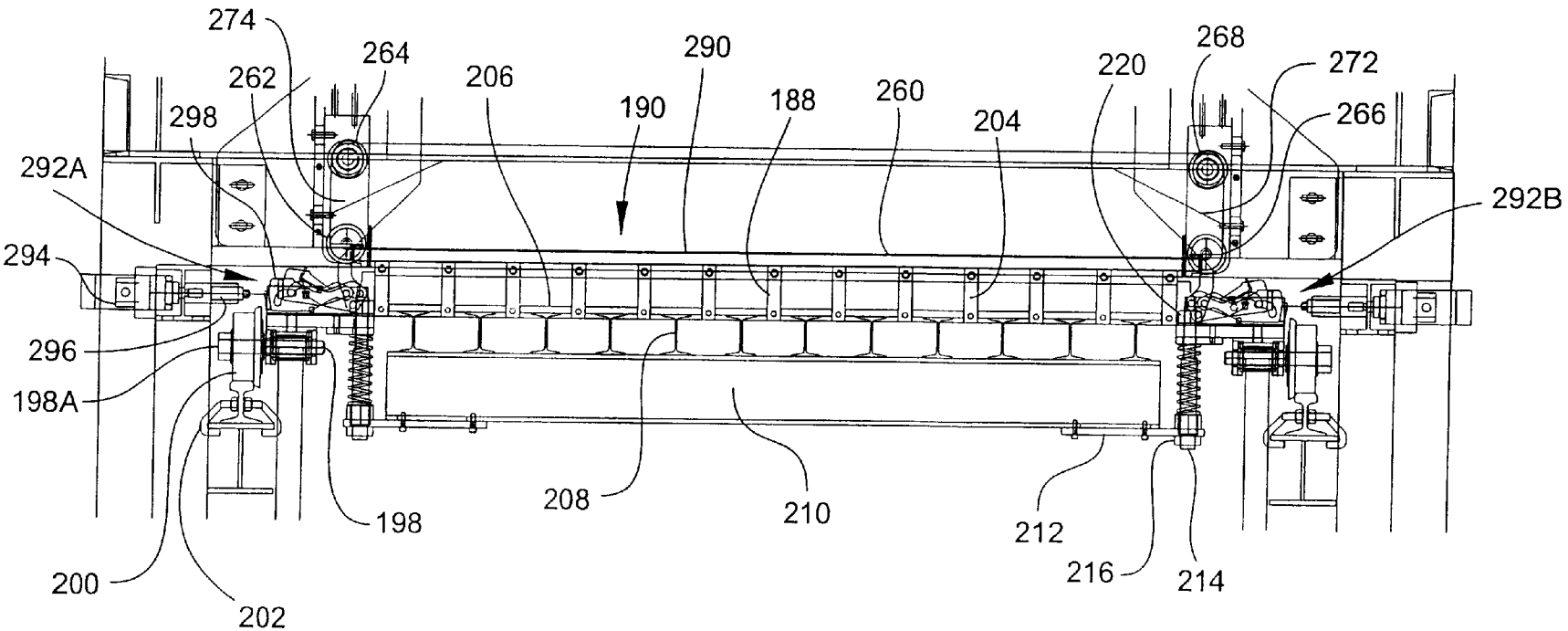
FIG. 11 is an end elevation showing the individual mold cavities of the mold section.

Referring to FIGS. 7, 11, and 12, from the mold filling station, the mold section 190 moves downstream to an overfill cutoff and removal station where excess clay is sheared off the open top of the mold cavities 188 and removed for recycling. As best shown in FIGS. 7 and 11, this station includes a continuous-loop cutting wire 260 carried by guide pulleys 262, 264, 266, and 268, and actuated by drive cylinder 270 to produce a back-and-forth sawing-type motion. The guide pulleys 262, 264, 266, and 268 are rotatably mounted to respective tension adjustment plates 272 and 274 secured to a frame member adjacent the clay extrusion assembly 20. The lower section of the cutting wire 260 is positioned at a precise elevation relative to the mold section 190 such that any excess clay in the mold cavities 188 is sheared off by the sawing motion of the cutting wire 260.

As shown in FIG. 12, as excess clay is removed by the cutting wire 260, it is loaded onto an inclined conveyor assembly 276. Preferably, a heat strip (not shown) extending the width of the mold conveyor 40 and located upstream of the inclined conveyor assembly 276 heats the excess clay to facilitate its loading onto the conveyor assembly 276. The conveyor assembly 276 includes pick-up belt 278 spanning the entire width of the mold conveyor 40, and carried by respective nose and head pulleys 280 and 282. A drive chain 284 connects the head pulley 282 to a motor 286 which operates to drive the pick-up belt 278. Upon reaching the upper end of the pick-up belt 278, the excess clay is passed to a second conveyor assembly 279 which transports the clay away from the mold conveyor 40 for re-mixing with the next batch of clay.

Pallet Application Station

Referring to FIGS. 11, 13, 15, 16, and 17, prior to reaching the downstream end of the mold conveyor 40, a pallet 290 is transferred from the pallet inversion station 80, and applied over the open top of the mold section 190 in a pallet application station. The pallet 290 is secured to the mold section 190 by opposing releasable locking assemblies 292A and 292B. As shown in FIG. 11, upon application of the pallet 290 to the mold section 190, an air cylinder 294 actuates a spring cushion 296 which extends outwardly to engage a pivoted holding lever 298. The holding lever 298 is fixed at one end to a pallet clamping arm 300 and at an opposite end to a control pin 302. The spring cushion 296 forces the holding lever 298 forward a distance defined by a travel slot 304 formed in the holding lever 298. A compression spring 306 then urges the holding lever 298 upwardly against the biasing force of a torsion spring 308 attached to the pallet clamping arm 300, such that the pallet clamping arm 300 extends over the pallet 290 to hold the pallet 290 in position upon inversion of the mold section 190 as it travels around the end of the mold conveyor 40.

Upon movement of the mold section 190 around the downstream end of the mold conveyor 40, as shown in FIG. 13, the pallet 290 remains clamped over the mold cavities 188 until engagement with a release mechanism 310 causing the clamping arms 300 to retract to their original open positions. The release mechanism engages the holding lever 298 which effects movement in a downward and rearward direction defined by the travel slot 304. In this position, the biasing force of the torsion spring 308 is sufficient to hold the clamping arm 300 open against the force of the compression spring 306.

Green Brick Ejector Station

Referring again to FIG. 13, once released, the pallet 290 falls downwardly onto a pair of spaced pallet transfer arms 311 (only one shown) of an elevator assembly 312, while a brick ejector assembly 314 operates to eject the green bricks from the mold cavities 188 and onto the released pallet 290. The brick ejector assembly 314 includes a drive cylinder 316 connected to a cam plate 318 pivotably mounted on a pivot shaft 320. Cam push arms 322 are fixed to the cam plate 318, and operate to engage the cross beam 210 of the mold section 190 (See FIG. 11) upon actuation of the drive cylinder 316 and pivoting movement of the cam plate 318. As the cam push arms 322 engage the cross beam 210, the cross beam 210 is urged against the biasing force of the spring-loaded guide shafts 214 in a direction towards the mold cavities 188. This movement of the cross beam 210 causes simultaneous movement of the base plates 206 inside respective mold cavities 188, thereby forcing the green bricks outwardly from the mold section 190 and onto the released pallet 290. As the drive cylinder 316 retracts, the cam arms 322 disengage the cross beam 210 of the mold section 190, while the spring-loaded guide shafts 214 return the cross beam 210 and base plates 206 of the mold section 190 to their original position. The loaded pallet 290 is then carried downwardly on the transfer arms 311 of the elevator assembly 312. The elevator assembly 312 is actuated by control cylinders 324 attached to respective guide plates 326 on each side of the mold conveyor 40. Each guide plate 326 includes a number of followers 328 which engage the cam track 330 as the transfer arms 311 are lifted and lowered. From the elevator assembly 312, the loaded pallet 290 is moved away from the mold conveyor 40, as described below, for loading onto transport rack "R". As shown in FIG. 1, the transport rack "R" transports the loaded pallet 290 to a remote brick drying room "D" where the green bricks are heated and dried.

Mold Reconditioning Station

Referring to FIG. 12, with the pallet 290 removed, the mold section 190 is further indexed downstream through a mold reconditioning station including a washing chamber 332, a drying chamber 334, a misting chamber 336, and a sand coating chamber 338. In the washing chamber 332, two pairs of laterally-spaced oscillating water spray nozzles 340 and 342 cooperate to clean the interior surfaces of all mold cavities 188. The first pair of nozzles 340 produces a high-pressure water spray sufficient to remove a majority of clay residue adhering to the interior walls of the mold cavities 188. The second pair of nozzles 342 provides a final rinse to remove any remaining reside. In the drying chamber 334, two pairs of laterally-spaced oscillating dryer vents 344 and 346 cooperate to dry the interior surfaces of all mold cavities 188. Preferably, oscillation of the spray nozzles 340, 342 and dryer vents 344, 346 of each respective pair is controlled by a single drive cylinder 348 and drive rod 350. In the misting chamber 336, laterally-spaced low pressure misting nozzles 352 (only one shown) operate to apply a carefully controlled volume of water to all interior surfaces of the mold cavities 188. In the sand coating chamber 338, a chamber housing 354 contains dry sand which is agitated by paddles 356 to create an atmosphere of sand particles. Fan blades 358 positioned within the housing 354 create air streams entraining the sand particles and directing them towards the water-misted mold cavities 188. A protective grid plate 360 is preferably attached to the chamber housing 354 to control and further direct the flow of dust particles. The paddles 356 and fan blades 358 are powered by a drive chain 362 and motor 364. After sand coating, the mold section 190 passes over a laterally-extending surface brush 366 which removes any excess sand from outside the mold cavities 188. At this point, the mold section 190 is fully processed and ready for movement back into the filling station to receive another batch of clay slugs.

Processing Green Bricks and Pallets

Figure 18:
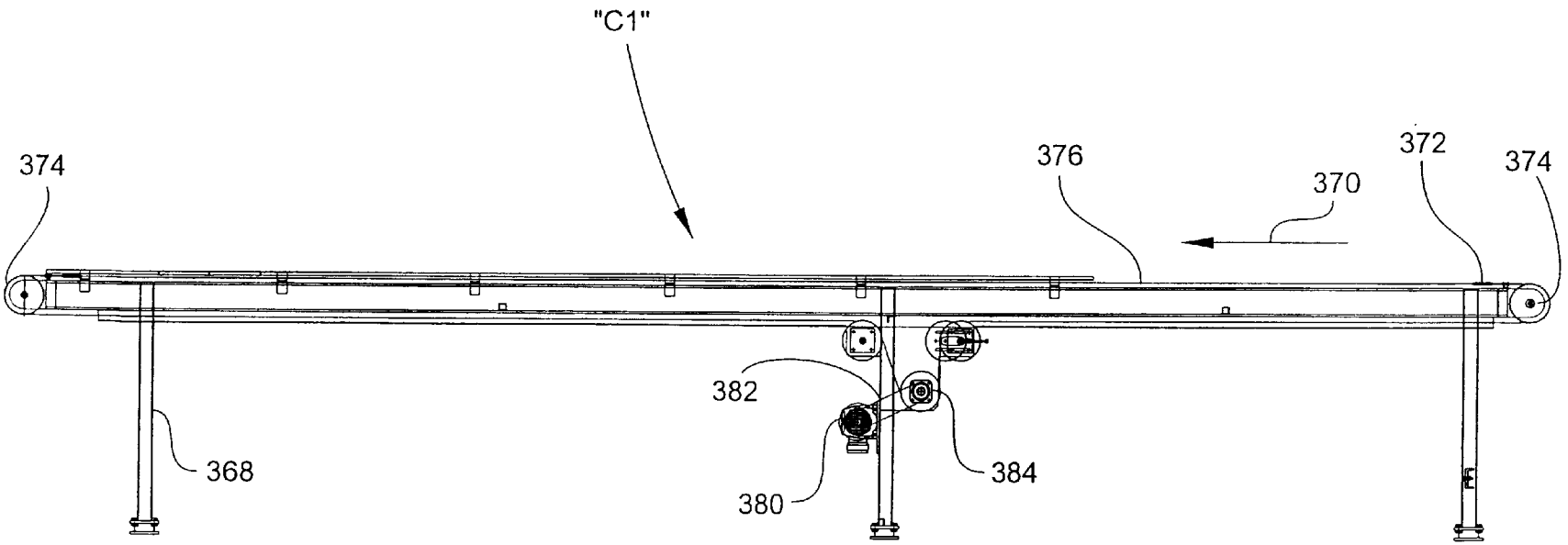
FIG. 18 is a side elevation of a chain conveyor employed in the brick molding process of the present invention.
Figure 19:
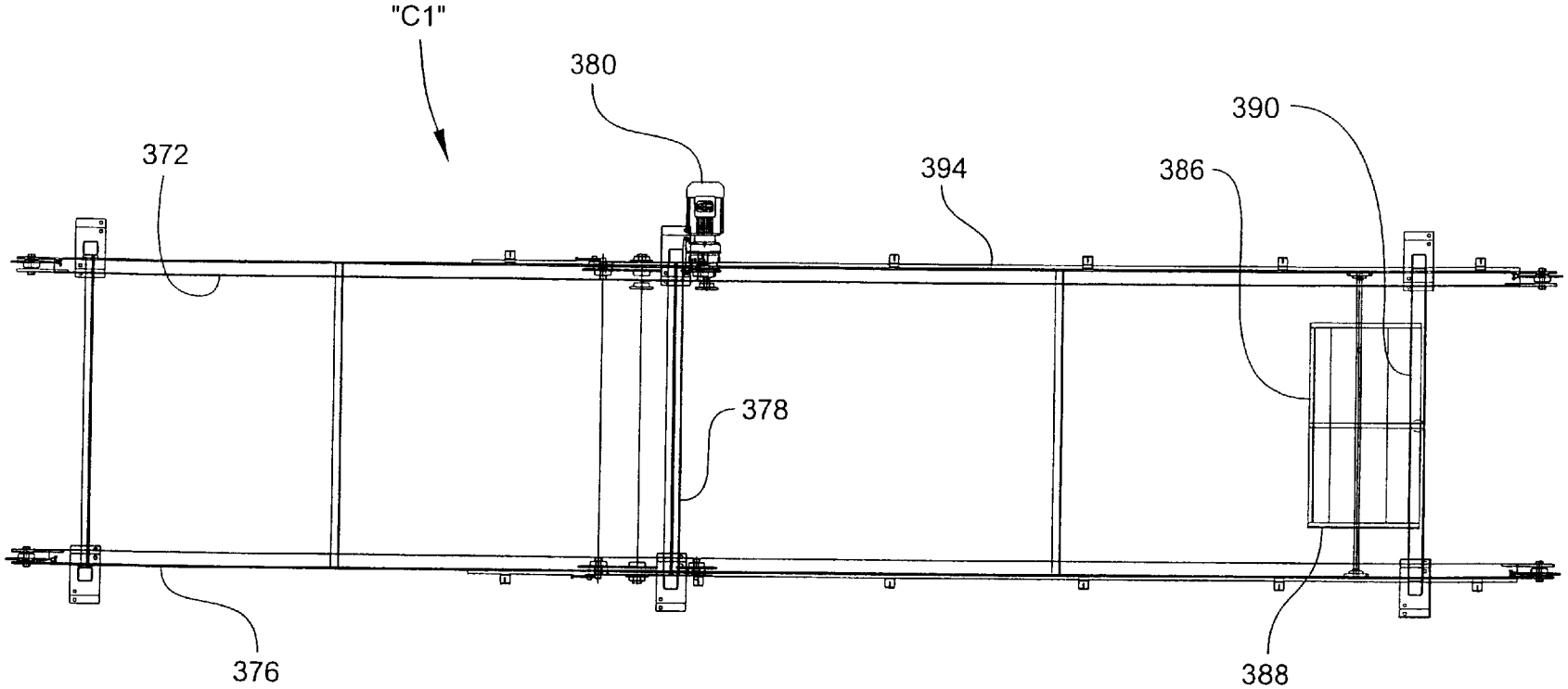
FIG. 19 is a top plan view of the chain conveyor.

As shown in FIGS. 1, 18 and 19, from the elevator assembly 312 of the brick ejector station, the loaded pallet 290 is transferred to the load end of the chain conveyor "C1". The chain conveyor "C1" is mounted on support frame 368, and moves in the direction indicated by arrow 370. The chain conveyor "C1" includes laterally spaced pallet chains 372 attached to respective pairs of idler sprocket wheels 374 and guide rails 376. The pallet chains 372 are operatively connected to a lateral drive shaft 378 actuated by motor 380, drive chain 382, and drive sprocket wheel 384.

Figure 20:
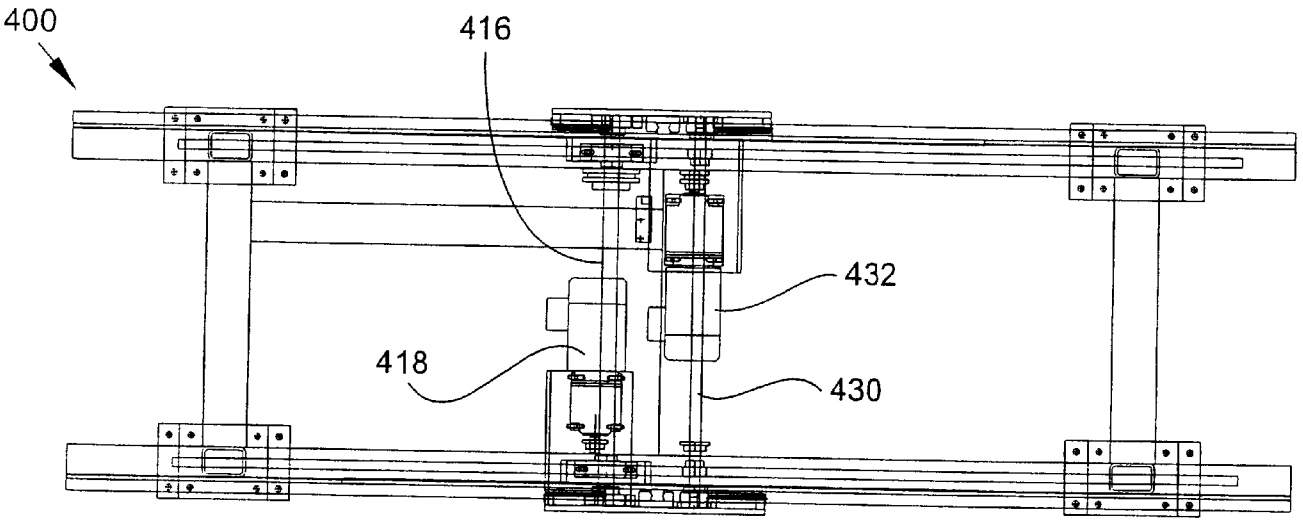
FIG. 20 is a top plan view of a pallet shuttle employed in the brick molding process of the present invention.
Figure 21:
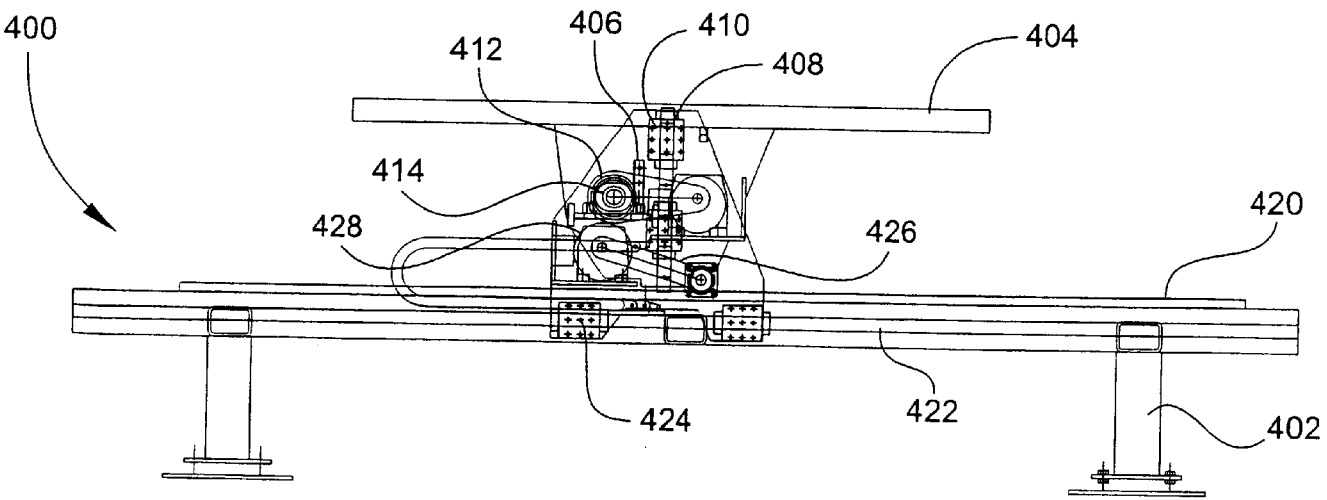
FIG. 21 is a side elevation of the pallet shuttle.
Figure 22:
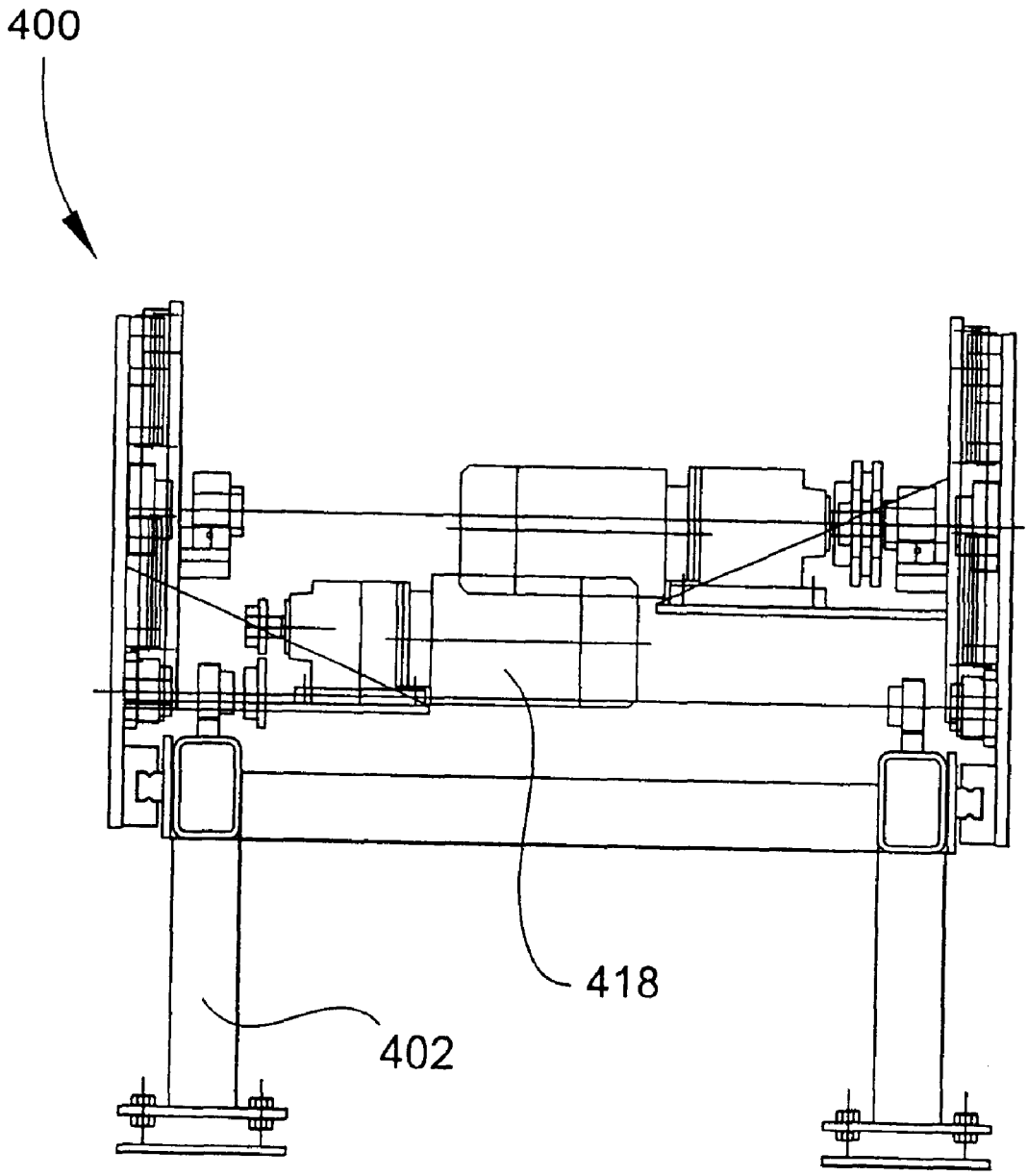
FIG. 22 is an end elevation of the pallet shuttle.
Figure 23:
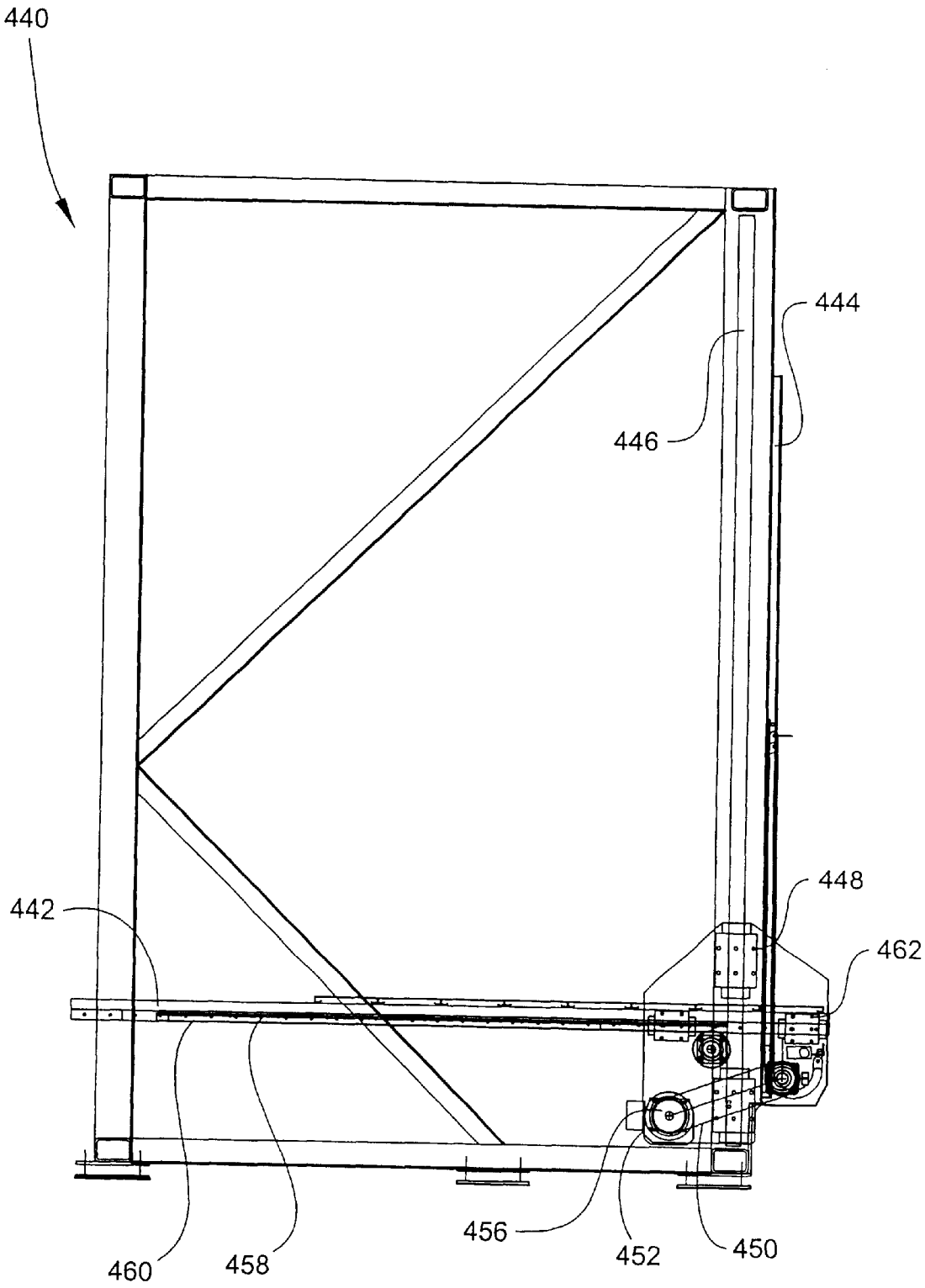
FIG. 23 is a side elevation of a pallet elevator employed in the brick molding process of the present invention.
Figure 24:
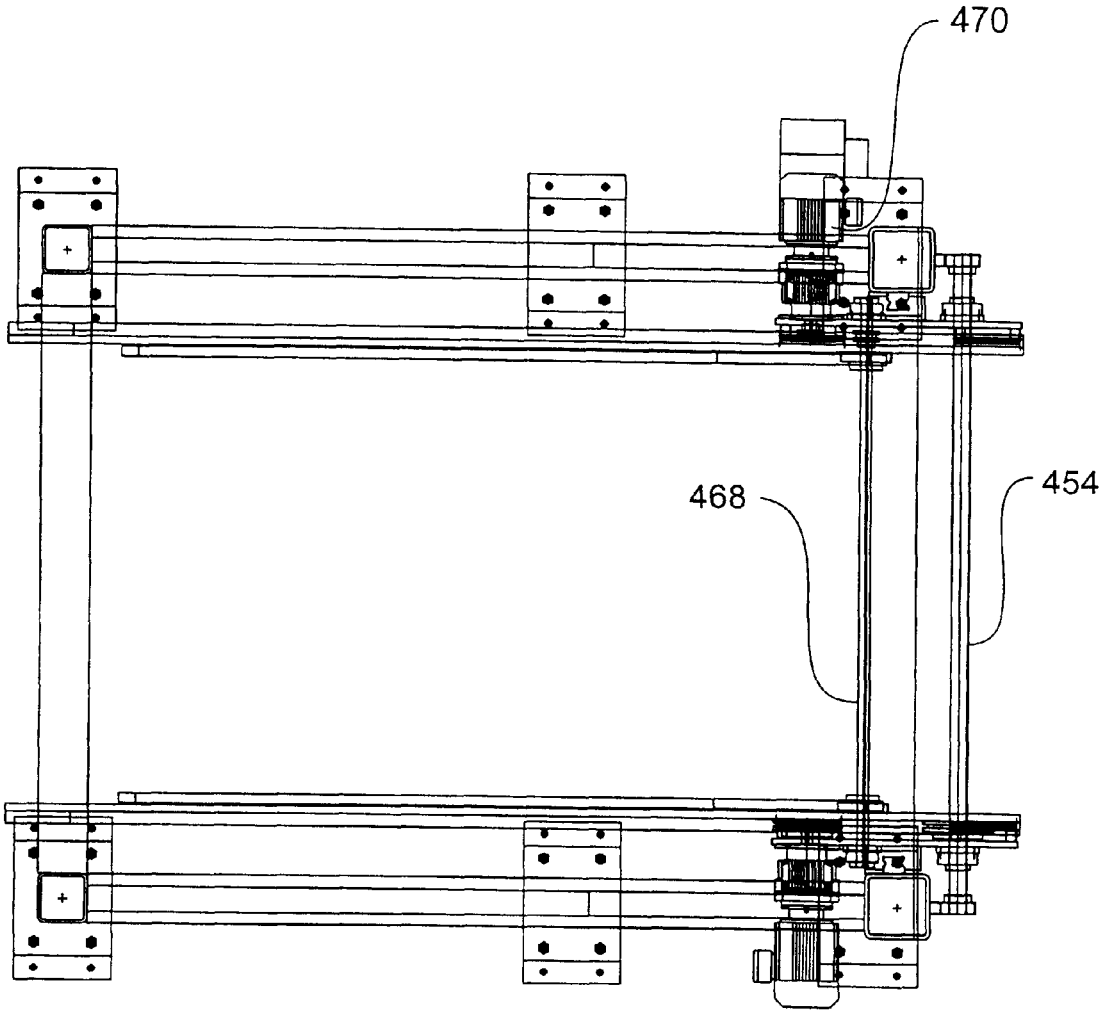
FIG. 24 is a top plan view of the pallet elevator.
Figure 25:
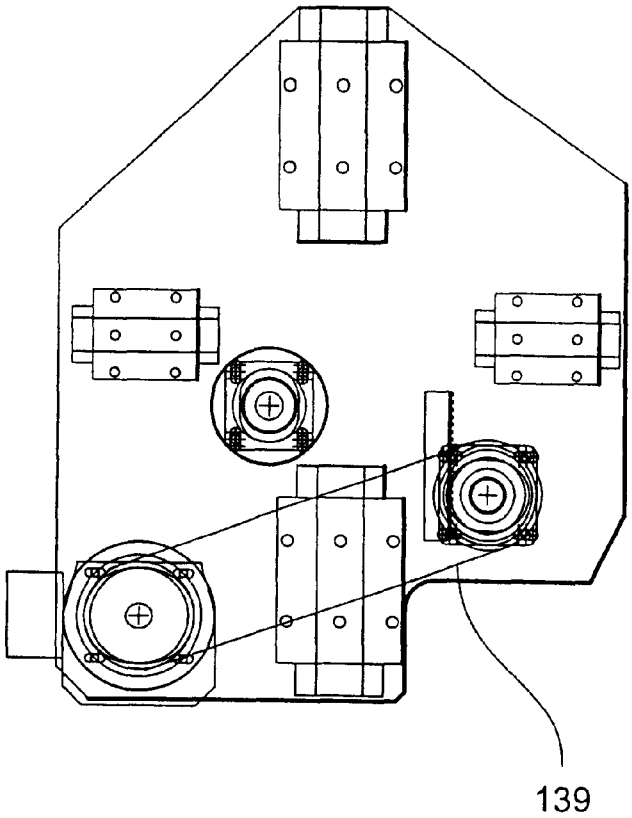
FIG. 25 is a view of the horizontal drive assembly of the pallet elevator.
Figure 26:
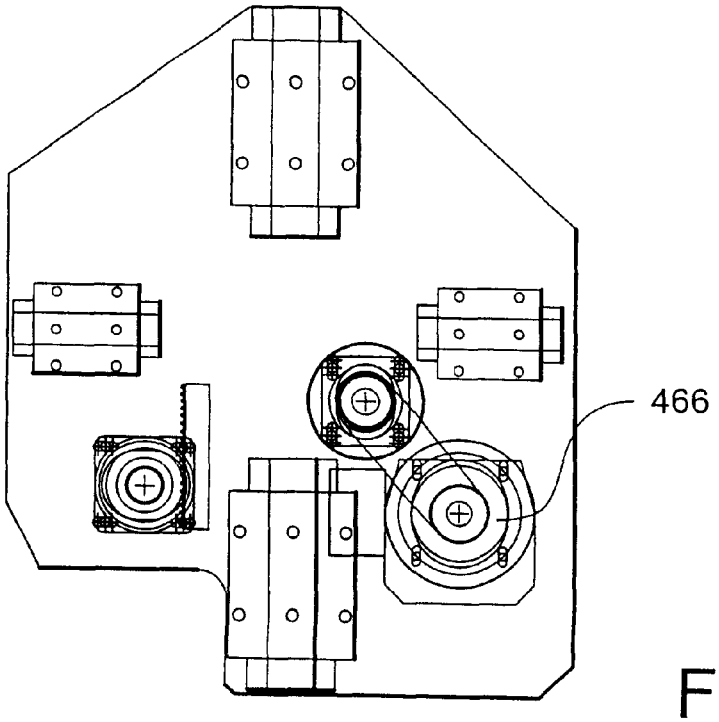
FIG. 26 is a view of the vertical drive assembly of the pallet elevator.

A pallet shuttle 400, shown in FIGS. 20–22, is mounted on base frame 402 at the discharge end of the chain conveyor "C1" and includes a pair of spaced transfer arms 404 adapted for movement in both a vertical and horizontal direction in order to lift and remove the eight loaded pallets 290 from the chain conveyor "C1". The transfer arms 404 are moved vertically by cooperating pairs of gear racks 406, bearing rails 408, linear bearings 410, drive chains 412, and sprocket wheels 414. The sprocket wheels 414 are attached to opposing ends of a drive shaft 416 actuated by drive motor 418. Horizontal movement of the transfer arms 404 is effected by cooperating pairs of gear racks 420, bearing rails 422, linear bearings 424, drive chains 426, and sprocket wheels 428. The sprocket wheels 428 are attached to opposing ends of a drive shaft 430 actuated by drive motor 432.

The pallet shuttle 400 lifts and transfers the loaded pallets 290 from the chain conveyor "C1" to an elevator 440, shown in FIGS. 23–26. Upon horizontal movement away from the chain conveyor "C1", the transfer arms 404 of the shuttle 400 lower vertically to place the pallets 290 onto a pair of spaced elevator placement arms 442. The elevator placement arms 442 are adapted for both horizontal and vertical movement in order to insert the loaded pallets 290 into the pallet transport rack "R". The elevator placement arms 442 are moved vertically by cooperating pairs of gear racks 444, bearing rails 446, linear bearings 448, drive chains 450, and sprocket wheels 452. The sprocket wheels 452 are attached to opposing ends of a drive shaft 454 actuated by drive motor 456. Horizontal movement of the transfer arms 442 is effected by cooperating pairs of gear racks 458, bearing rails 460, linear bearings 462, drive chains 464, and sprocket wheels 466. The sprocket wheels 466 are attached to opposing ends of a drive shaft 468 actuated by drive motor 470. After the pallet transport rack "R" is filled, it is moved to the drying room "D" where the green bricks are dried.

Figure 27:
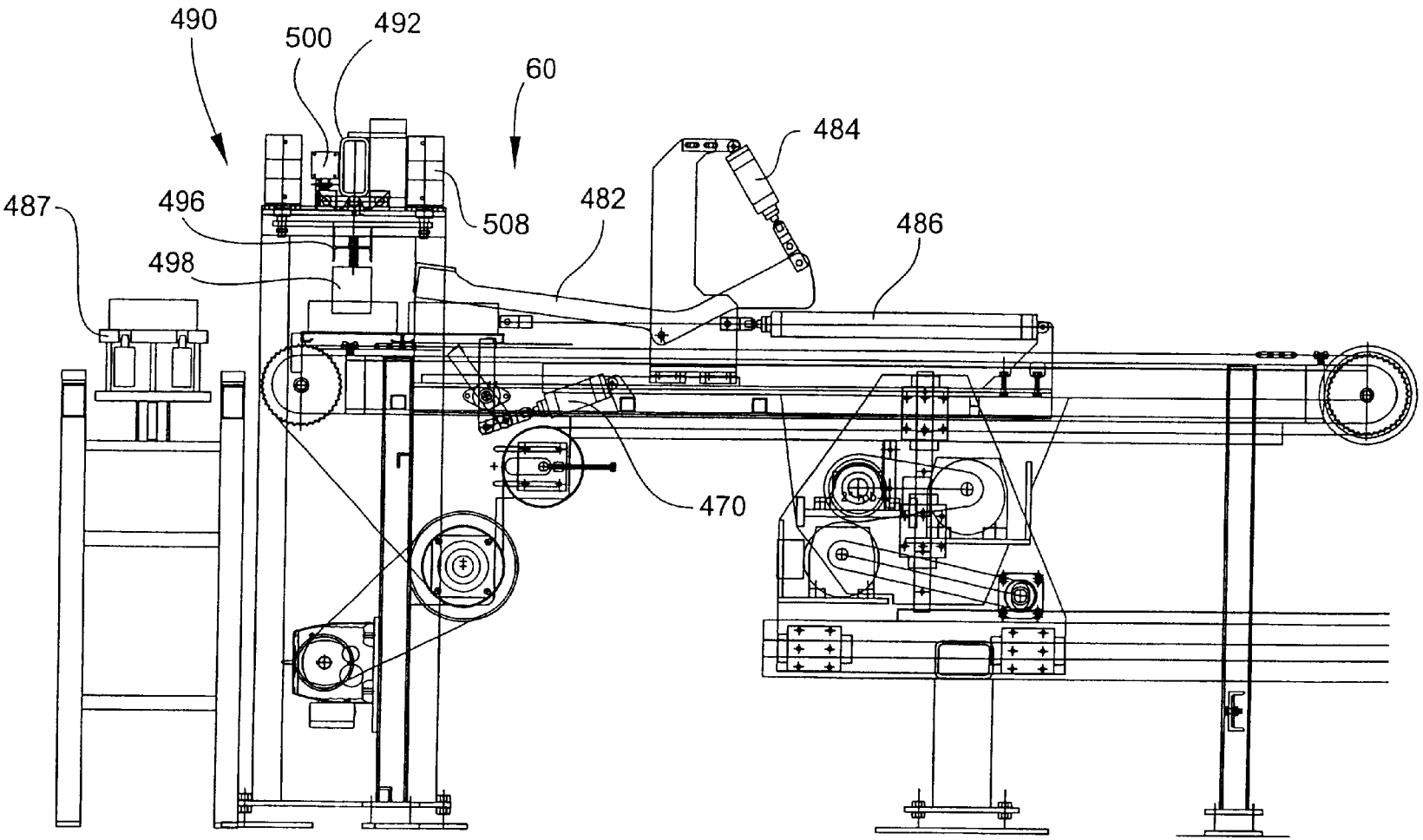
FIG. 27 is a side elevation of the brick stripper assembly employed in the brick molding process of the present invention.
Figure 28:
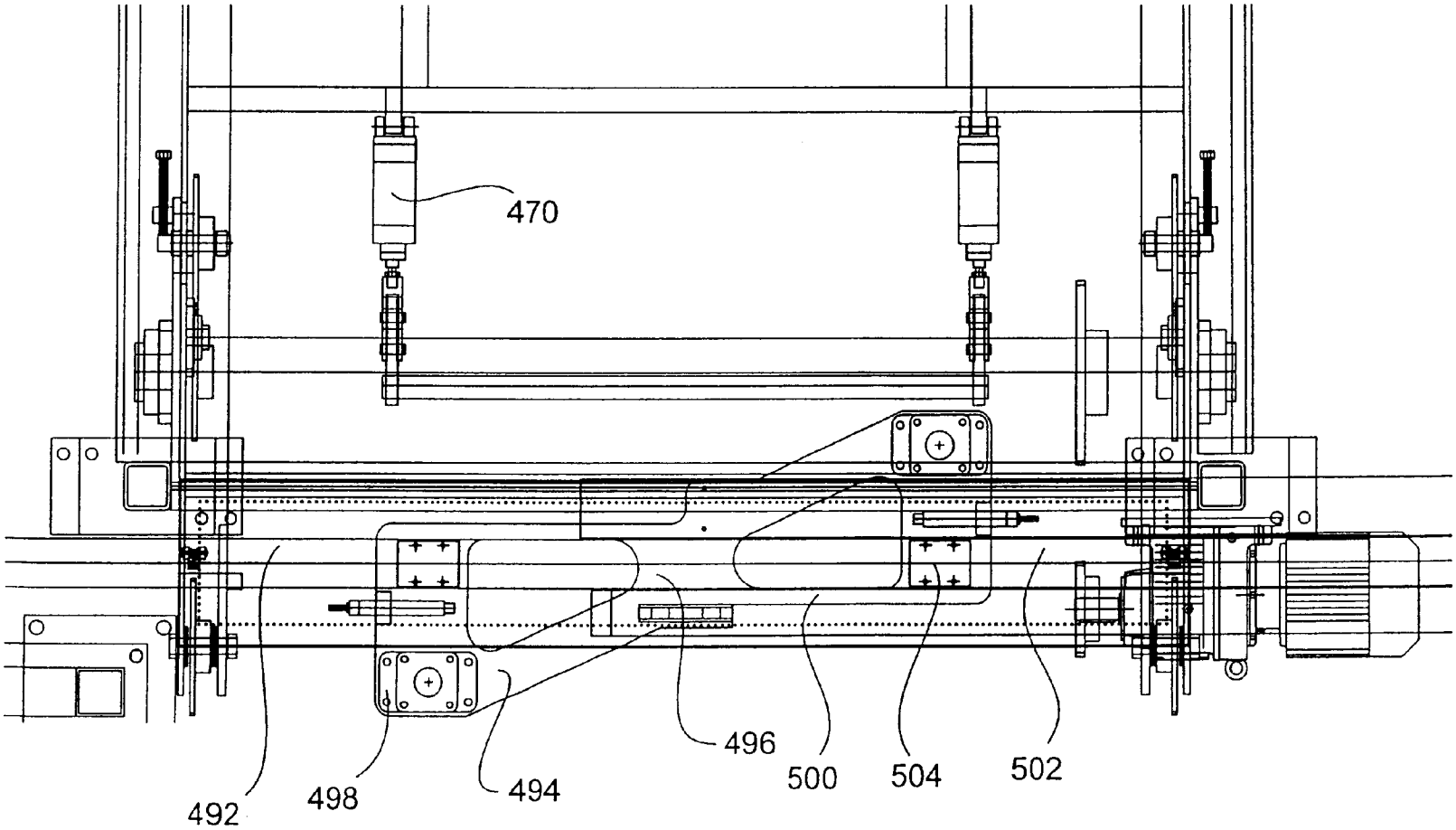
FIG. 28 is a top plan view illustrating a portion of the magnetic pallet spotter.

From the drying room "D", the loaded pallets 290 are transferred on transport racks "R" to the brick stripper station 60, shown in FIGS. 1, 27, and 28. The pallets 290 are unloaded from the pallet transport rack "R" by reverse operation of an elevator and shuttle, identical to those previously described. The elevator and shuttle cooperate to load the pallets 290 onto a conveyor "C2" to a cylinder-driven index assembly 470 the brick stripper station 60. In the brick stripper station 60, the loaded pallets 290 are moved downstream where the dried bricks engage a stripper arm 482. The stripper arm 482 is powered by cooperating air cylinders 484 and 486 which actuate causing the stripper arm 482 to push the dried bricks off the pallet 290 and onto a brick transport conveyor 487 to the oven "O". A magnetic pallet spotter 490 including a carrier frame 492, a magnetic shuttle plate 494, a hanger frame 496, and bipolar magnet 498 engages the empty metal pallets 290 and delivers the pallets 290 to conveyor "C3" (See FIG. 1). A rodless air cylinder 500, bearing rail 502, and linear bearing 504 cooperate to move the pallet spotter 490 horizontally, while air cylinder 508 enables vertical movement. Conveyor "C3" moves the empty pallets 290 downstream to a shuttle and elevator which cooperate, as previously described, to load the pallets 290 into transport racks "R" for transport to the pallet storage area "S".

Figure 29:
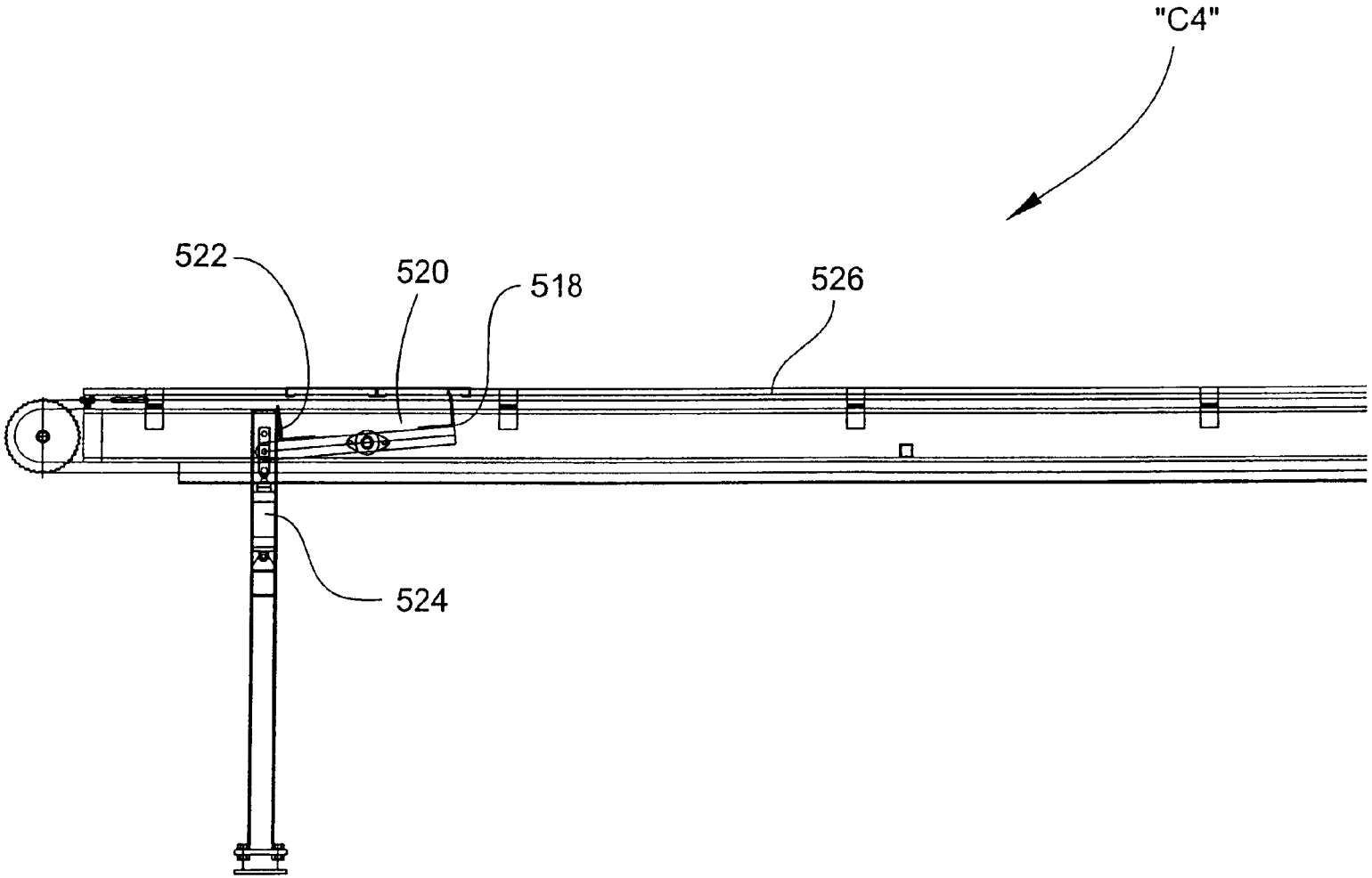
FIG. 29 is a side elevational view of the discharge end of the chain conveyor used for moving the pallets to the pallet inversion station.
Figure 30:
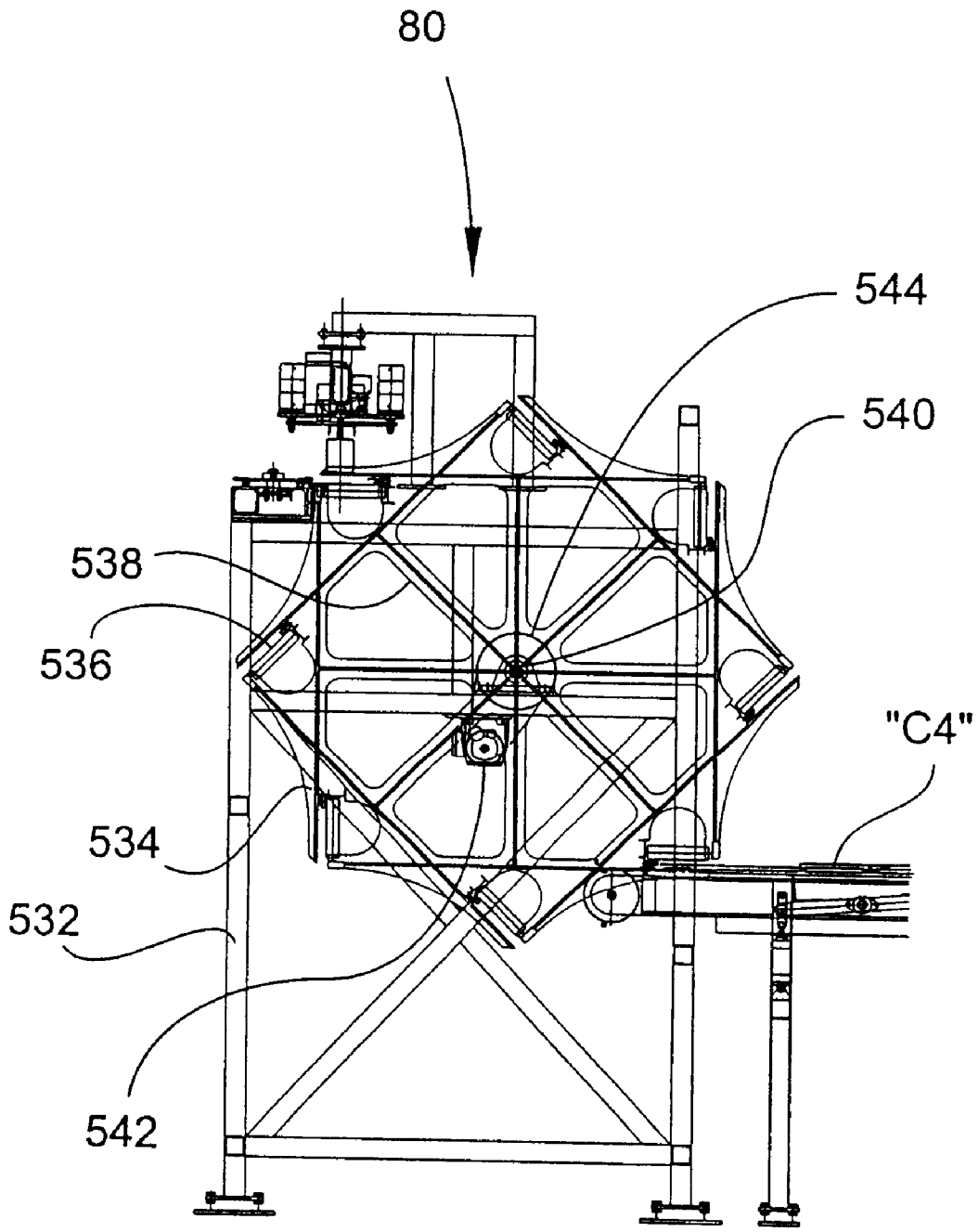
FIG. 30 is a side elevation of the pallet inversion station.
Figure 31:
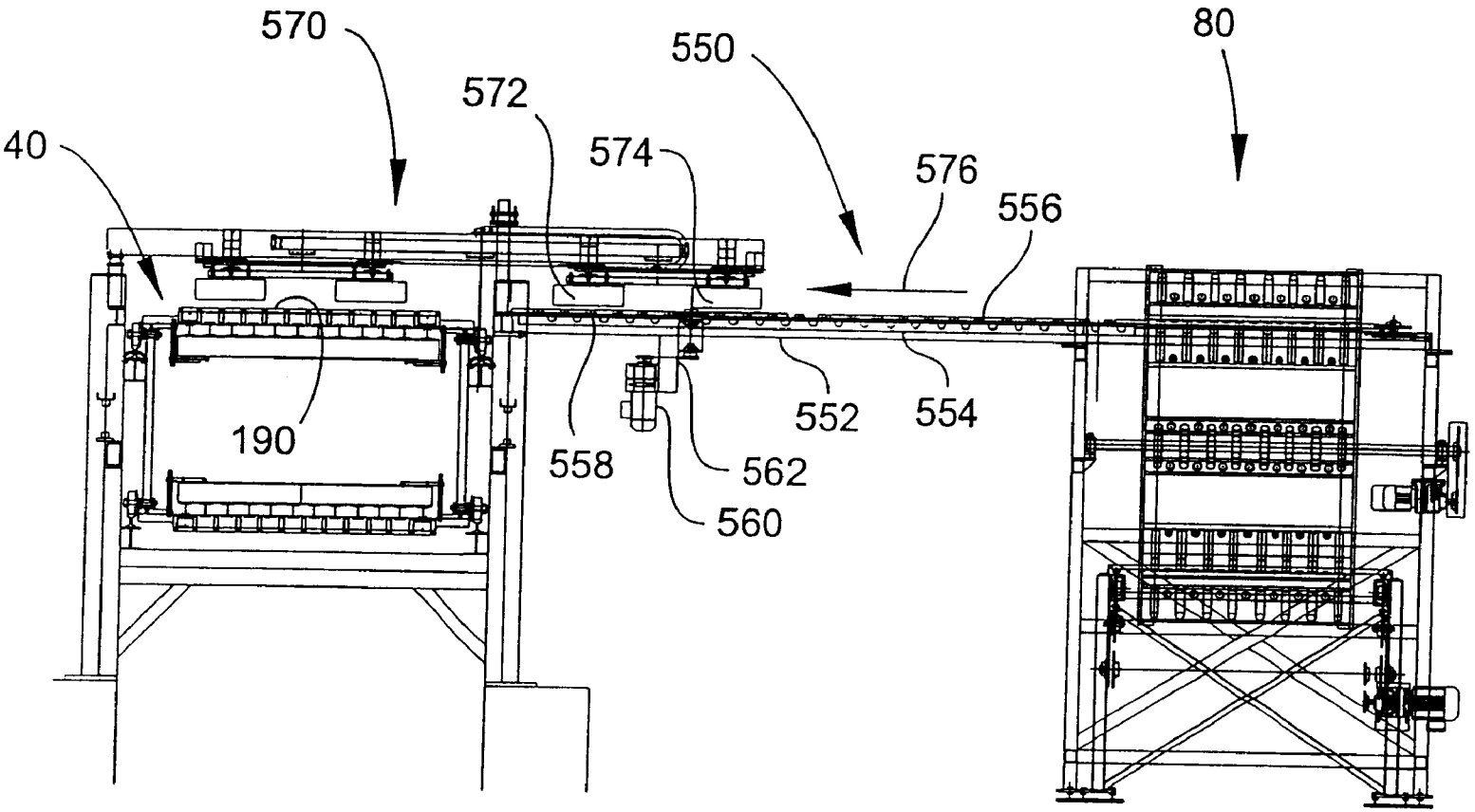
FIG. 31 is an end elevation of the pallet inversion station, and showing the horizontal conveyor assembly and magnetic pallet spotter which cooperate to receive and transfer the inverted pallets onto the mold section of the mold conveyor.

Referring to FIGS. 1, 29, 30, and 31, from the pallet storage area "S", the transport racks "R" are moved in sequence to the loading end of chain conveyor "C4". An elevator and shuttle, identical to those previously described, remove the empty pallets 290 from the transport rack "R" and position the pallets 290 onto the chain conveyor "C4". The chain conveyor "C4" moves the pallets 290 downstream to a stop guide 518 located at an opposite discharge end of the chain conveyor "C4", as shown in FIG. 29. Pallets 290 accumulate at the discharge end of the chain conveyor "C4" and are indexed by a rocker arm 520, index plate 522, and index cylinder 524 in a preferred group of eight pallets 290. Laterally-spaced alignment rails 526 cooperate to align the pallets 290 and deliver the pallets 290 to the inversion station 80 one at a time. The inversion station 80, shown in FIGS. 30 and 31, includes a support frame 532, guide rollers 534, and roller conveyors 536. The roller conveyors 536 are carried on a rotating inversion wheel 538 actuated by a drive shaft pulley 540 operatively attached to a drive motor 542 and drive chain 544. The inversion wheel 538 rotates counterclockwise to invert and deliver the empty pallet 290 onto a horizontal pallet conveyor assembly 550. The horizontal pallet conveyor assembly 550 is mounted on a base frame 552 and includes a roller conveyor 554 with guide wheels 556 and opposing conveyor chains 558. A drive motor 560 cooperates with drive chain 562 to actuate conveyor chain sprocket wheels 564 operatively attached to the conveyor chains 558. The conveyor chains 558 move the empty pallets 290 to a magnetic pallet spotter 570. The magnetic pallet spotter 570 includes bipolar magnets 572 and 574 which engage the metal pallets 290 on the horizontal pallet conveyor assembly 550, and transfer the pallets 290 horizontally as indicated by direction arrow 576 to the mold conveyor 40. When properly positioned in registration over the open mold section 190, the magnets 572, 574 release the pallet 290 onto the mold section 190. The pallet 290 is then clamped to the mold section 190 of the mold conveyor 40, as previously described.

A brick molding apparatus and method are described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

What is claimed is:

1. In a brick molding apparatus, the improvement comprising a mechanical drive assembly for indexing in predetermined incremental movements a mold adapted to receive and shape clay slugs into green bricks, said drive assembly comprising:

a conveyor for carrying the mold in the brick molding apparatus;

a drive gear mounted on a drive shaft and defining a plurality of circumferentially-spaced teeth and radially-extending slots, said drive shaft being operatively connected to said conveyor;

a drive lug adapted for movement into and out of a selected one of said plurality of slots formed in said drive gear;

a drive-lug actuator for moving said drive lug into and out of the selected slot of said drive gear, said drive-lug actuator comprising a cylinder assembly including an extendable and retractable piston connected to said drive lug; and a gear actuator adapted for moving said drive lug in a rotational direction relative to said drive shaft, such that when said drive lug is positioned in the selected slot of said drive gear, said gear actuator causes rotation of said drive gear and drive shaft thereby indexing said conveyor and mold.

2. A combination according to claim 1, wherein said conveyor comprises first and second spaced-apart sprocket wheels, and a continuous-loop sprocket chain carried by said sprocket wheels and adapted for indexing the mold in a continuous-loop path.

3. A combination according to claim 1, wherein said gear actuator comprises a hydraulic cylinder assembly including an extendable and retractable piston connected to an operating arm and adapted for moving said operating arm and drive lug in a rotational direction relative to said drive shaft.

4. A mechanical drive assembly for a brick molding apparatus, said drive assembly operating to index in predetermined incremental movements a mold adapted for receiving and shaping clay slugs into green bricks, said drive assembly comprising:

a conveyor for carrying the mold in the brick molding apparatus;

a drive gear mounted on a drive shaft and defining a plurality of circumferentially-spaced teeth and radially-extending slots, said drive shaft being operatively connected to said conveyor;

a drive lug adapted for movement into and out of a selected one of said plurality of slots formed in said drive gear;

a drive-lug actuator for moving said drive lug into and out of the selected slot of said drive gear, said drive-lug actuator comprising a cylinder assembly including an extendable and retractable piston connected to said drive lug; and a gear actuator adapted for moving said drive lug in a rotational direction relative to said drive shaft, such that when said drive lug is positioned in the slot of said drive gear, said gear actuator causes rotation of said drive gear and drive shaft thereby indexing said conveyor and mold.

5. A mechanical drive assembly according to claim 4, wherein said conveyor comprises first and second spaced-apart sprocket wheels, and a continuous-loop sprocket chain carried by said sprocket wheels and adapted for indexing the mold in a continuous-loop path.

6. A mechanical drive assembly according to claim 4, and comprising an elongate operating arm attached at one end thereof to a bearing carried on said drive shaft adjacent said drive gear, and at an opposite end thereof to said drive-lug actuator, said operating arm defining a longitudinal lug track for guiding movement of said drive lug into and out of the selected slot of said drive gear.

7. A mechanical drive assembly according to claim 6, wherein said gear actuator comprises a hydraulic cylinder assembly including an extendable and retractable piston connected to said operating arm and adapted for moving said operating arm and drive lug in a rotational direction relative to said drive shaft.

8. A mechanical drive assembly for a brick molding apparatus, said drive assembly operating to index in predetermined incremental movements a mold adapted for receiving and shaping clay slugs into green bricks, said drive assembly comprising:

(a) a conveyor for carrying the mold in the brick molding apparatus;

(b) a drive gear mounted on a drive shaft and defining a plurality of circumferentially-spaced teeth and radially-extending slots, said drive shaft being operatively connected to said conveyor;

(c) a drive lug adapted for movement into and out of a selected one of said plurality of slots formed in said drive gear;

(d) a drive-lug actuator comprising a drive-lug cylinder assembly including an extendable and retractable piston connected to said drive lug for moving said drive lug into and out of the selected slot of said drive gear; and (e) a gear actuator adapted for moving said drive lug in a rotational direction relative to said drive shaft, such that when said drive lug is positioned in the slot of said drive gear, said gear actuator causes rotation of said drive gear and drive shaft thereby indexing said conveyor and mold.

9. In a brick molding apparatus, the improvement comprising a mechanical drive assembly for indexing in predetermined incremental movements a mold adapted to receive and shape clay slugs into green bricks, said drive assembly comprising:

a conveyor for carrying the mold in the brick molding apparatus;

a drive gear mounted on a drive shaft and defining a plurality of circumferentially-spaced teeth and radially-extending slots, said drive shaft being operatively connected to said conveyor;

a drive lug adapted for movement into and out of a selected one of said plurality of slots formed in said drive gear;

a drive-lug actuator for moving said drive lug into and out of the selected slot of said drive gear;

an elongate operating arm attached at one end thereof to a bearing carried on said drive shaft adjacent said drive gear, and at an opposite end thereof to said drive-lug actuator, said operating arm defining a longitudinal lug track for guiding movement of said drive lug into and out of the selected slot of said drive gear; and a gear actuator adapted for moving said drive lug in a rotational direction relative to said drive shaft, such that when said drive lug is positioned in the selected slot of said drive gear, said gear actuator causes rotation of said drive gear and drive shaft thereby indexing said conveyor and mold.

* * * * *